US009321256B2

(12) United States Patent
Skakal et al.

(10) Patent No.: US 9,321,256 B2
(45) Date of Patent: Apr. 26, 2016

(54) SYSTEM FOR APPLYING IMAGES TO PLANAR SURFACES OF A TARGET OBJECT

(75) Inventors: Todd Skakal, Lancaster, NY (US); William Elliott, Alden, NY (US); Daniel Destino, North Tonawanda, NY (US); Eric Steinwachs, East Amherst, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 493 days.

(21) Appl. No.: 13/585,027

(22) Filed: Aug. 14, 2012

(65) Prior Publication Data

US 2014/0047987 A1 Feb. 20, 2014

(51) Int. Cl.
*B41F 16/00* (2006.01)

(52) U.S. Cl.
CPC ..... *B41F 16/0026* (2013.01); *B41F 16/008* (2013.01); *B41F 16/0033* (2013.01); *B41P 2219/20* (2013.01); *B41P 2219/43* (2013.01)

(58) Field of Classification Search
CPC ..... B41F 16/008; B41F 16/0026; B41F 16/0033; B41F 16/0046; B41P 2219/43; B41P 2219/20; B41J 3/4073
USPC ..... 101/7, 8, 9, 10, 11, 25, 27, 31, 33, 34
See application file for complete search history.

(56) References Cited

U.S. PATENT DOCUMENTS 3,089,414 A * 5/1963 Jenkins ..... B41F 15/0872 101/124
6,568,320 B2 5/2003 Wada et al.
7,495,162 B1 2/2009 Pokallus
8,683,921 B2 * 4/2014 Poeling ..... B65C 3/163 101/33
2007/0199455 A1 * 8/2007 Paita ..... B41F 15/0877 101/35
2010/0242762 A1 * 9/2010 Demange ..... B41F 15/0872 101/407.1

FOREIGN PATENT DOCUMENTS

EP 1820647 A2 8/2007
EP 2236296 A1 10/2010

OTHER PUBLICATIONS

ISR and W/O for PCT/US2013/054945, dated Dec. 3, 2013.

* cited by examiner

*Primary Examiner* — Leslie J Evanisko

(74) *Attorney, Agent, or Firm* — The Small Patent Law Group LLC; Christopher R. Carroll

(57) ABSTRACT

An image application system includes an articulator assembly and an applicator device. The articulator assembly holds a target object on which one or more images are to be applied from a web containing the one or more images. The target object includes an exterior surface having planar surface(s) and non-planar surface(s). The applicator device is configured to contact the web to engage the web with the exterior surface of the target object at an application interface between the web and the exterior surface. The one or more images are applied to the exterior surface from the web at the application interface. The articulator assembly is configured to move the target object in one or more linear directions and one or more rotary directions relative to the applicator device to apply the images to at least one of the one or more planar surfaces or the one or more non-planar surfaces.

20 Claims, 15 Drawing Sheets

SYSTEM FOR APPLYING IMAGES TO PLANAR SURFACES OF A TARGET OBJECT

BACKGROUND

A variety of printing systems can apply or print images (e.g., graphics, text, or the like) on exterior surfaces of objects. Many of these systems directly engage or contact the exterior surfaces on which the images are printed. For example, heat transfer printing, ink jet printing, and the like, can involve contact between the source of the image (e.g., a web having images to be thermally transferred, a print head, or other components) and the surface of the object on which the images are printed. For some objects that have both planar and non-planar surfaces, some known systems may be unable to apply images onto the surfaces. For example, some known systems that apply images from a continuous web using heat transfer may not be able to apply the images from the web onto an object having both flat and curved surfaces.

BRIEF SUMMARY

In one embodiment, an image application system includes an articulator assembly and an applicator device. The articulator assembly is configured to hold a target object on which one or more images are to be applied from a web containing the one or more images. The target object includes an exterior surface having one or more planar surfaces and one or more non-planar surfaces. The applicator device is configured to contact the web to engage the web with the exterior surface of the target object at an application interface between the web and the exterior surface. The one or more images are applied to the exterior surface from the web at the application interface. The articulator assembly is configured to move the target object in one or more linear directions and one or more rotary directions relative to the applicator device to apply the images to at least one of the one or more planar surfaces or the one or more non-planar surfaces.

In another embodiment, an articulator assembly of an image application system includes a platform and one or more motors. The platform is configured to hold a target object on which one or more images are to be applied from a web containing the one or more images. The target object includes an exterior surface having planar surfaces and at least one non-planar surface extending between the planar surfaces. The one or more motors are configured to move the platform in linear directions and a rotary direction relative to an applicator device that is configured to contact the web to engage the web with the exterior surface of the target object in order to apply the one or more images onto the exterior surface. The applicator device is separated from the exterior surface by a separation distance when the applicator device contacts the web to engage the web with the exterior surface. The one or more motors are configured to move the target object in one or more of the linear directions and the rotary direction by moving the platform. The one or more motors move the target object to maintain the separation distance between the applicator device and the exterior surface of the target object while the target object is moved such that the web engages the planar surfaces and the at least one non-planar surface during movement of the target object.

In another embodiment, a method for applying one or more images to a target object including an exterior surface having a planar surface and a non-planar surface is provided. The method includes engaging the exterior surface of the target object with a web at an application interface. The web includes the one or more images to be applied to the target object and held between the exterior surface of the target object and an applicator device. The method also includes moving the target object in a lateral direction to move the planar surface through the application interface and moving the target object in a transverse direction and in a rotary direction to move the non-planar surface through the application interface. The method further includes applying the one or more images to at least one of the planar surface or the non-planar surface during one or more of moving the target object in the lateral direction or moving the target object in the transverse direction and in the rotary direction. A separation distance between the exterior surface of the target object and the applicator device is maintained during moving the target object in the lateral direction and moving the target object in the transverse direction and in the rotary direction.

BRIEF DESCRIPTION OF THE DRAWINGS

Reference is now made briefly to the accompanying drawings, in which.

DETAILED DESCRIPTION

One or more embodiments of the inventive subject matter described herein relate to systems and methods for applying images onto surfaces of a target object having surfaces that are not co-planar. The printing may involve contact printing where physical contact or engagement is made between the bodies being printed upon (e.g., referred to herein as "target bodies" or "target objects") and a source of the images, designs, text, and the like, that is being printed on the target bodies. For example, the printing may involve heat transfer printing where a web or sheet including a wax transfer print of an image (as used herein, the term "image" may refer to graphics, text, and the like) is placed in contact with an exterior surface of the target object and the image is transferred from the web to the target object by application of heat. In one embodiment, the target object has one or more planar surfaces that receive the images and/or one or more non-planar surfaces that may or may not receive images. By "planar," it is meant that the surfaces are substantially flat and two dimensional, but may include some relatively small undulations, indentations, extensions, and the like. For example, a planar surface may be substantially planar when the surface has dimensions extending in two orthogonal directions that are substantially larger than the dimensions of the surface in a third orthogonal direction. "Non-planar" means surfaces that are not substantially flat and two dimensional, such as curves, slopes, protrusions, recesses, and the like.

The applying of the images onto the target object may be performed in a continuous manner such that one or more of the images are applied onto a first planar surface of the target object from a web of the images that is pressed against the surface by an applicator assembly. In one embodiment, the applicator assembly remains stationary and in contact with the web to maintain contact between the web and the target object. The target object may be moved in or more linear directions to maintain this contact between the web and the target object while the one or more images are applied to the first planar surface. The target object can be moved in one or more of the same and/or different linear directions and/or rotated when the contact between the web and the target object encounters a non-planar surface of the target object. For example, the target object may be moved when a corner (e.g., rounded or sharp corner) of the target object encounters the area of engagement (e.g., an application interface) between the web and the target object. The target object can be moved so that the application interface remains stationary or substantially stationary while moving across the non-planar surface.

Figure 1:
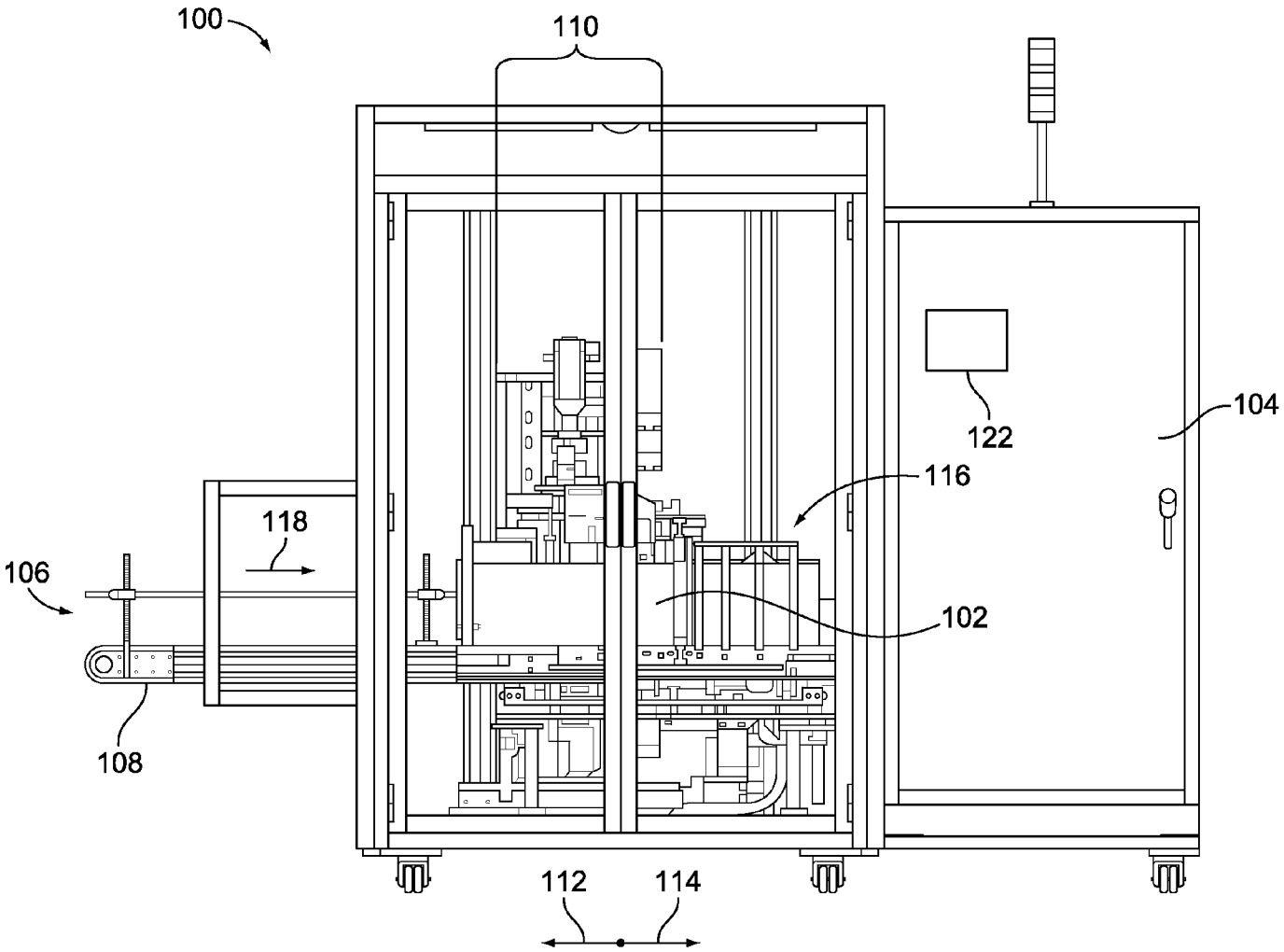
FIG. 1 is a front view of one embodiment of an image application system.
Figure 2:
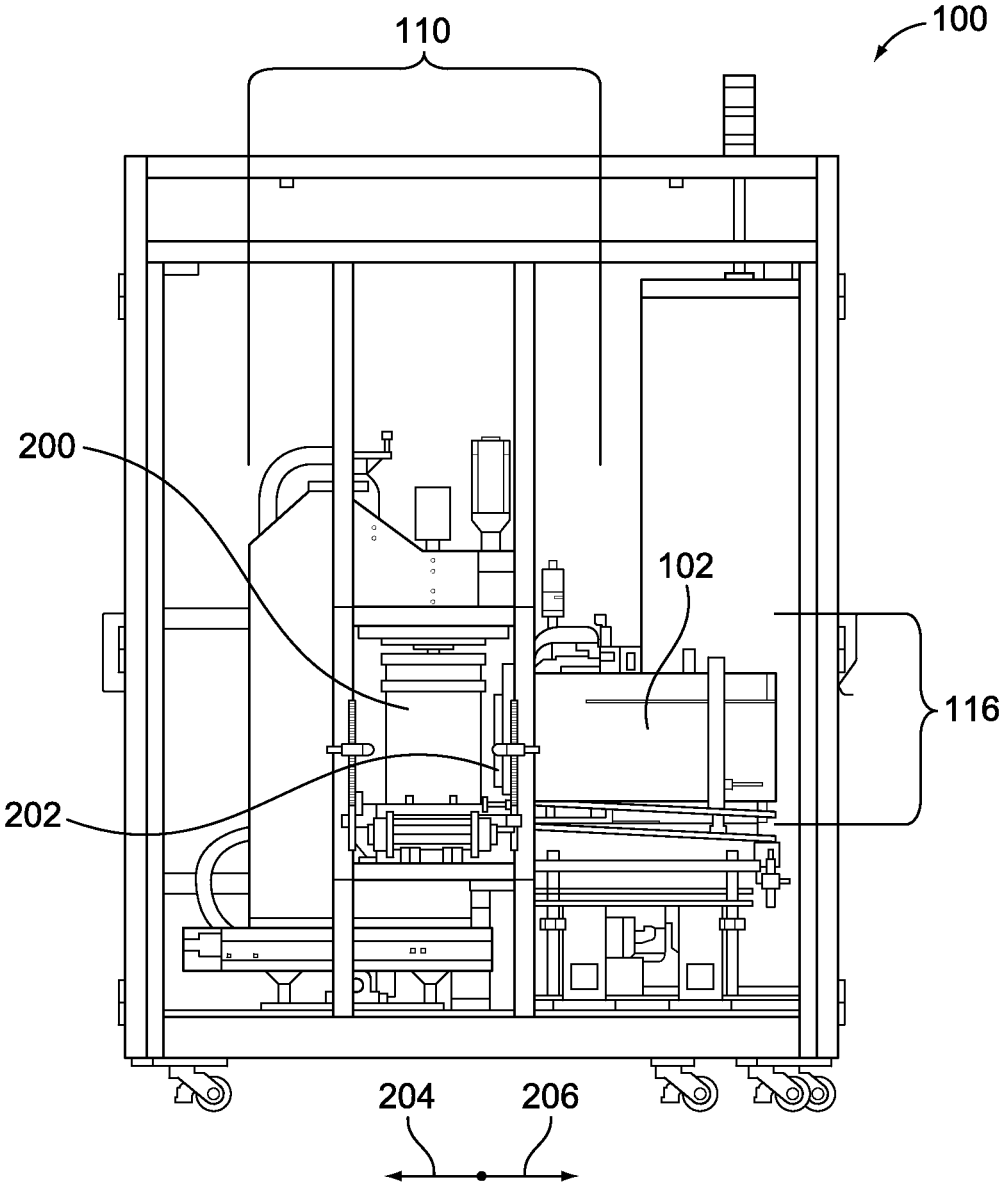
FIG. 2 is a side view of the image application system shown in FIG. 1.
Figure 3:
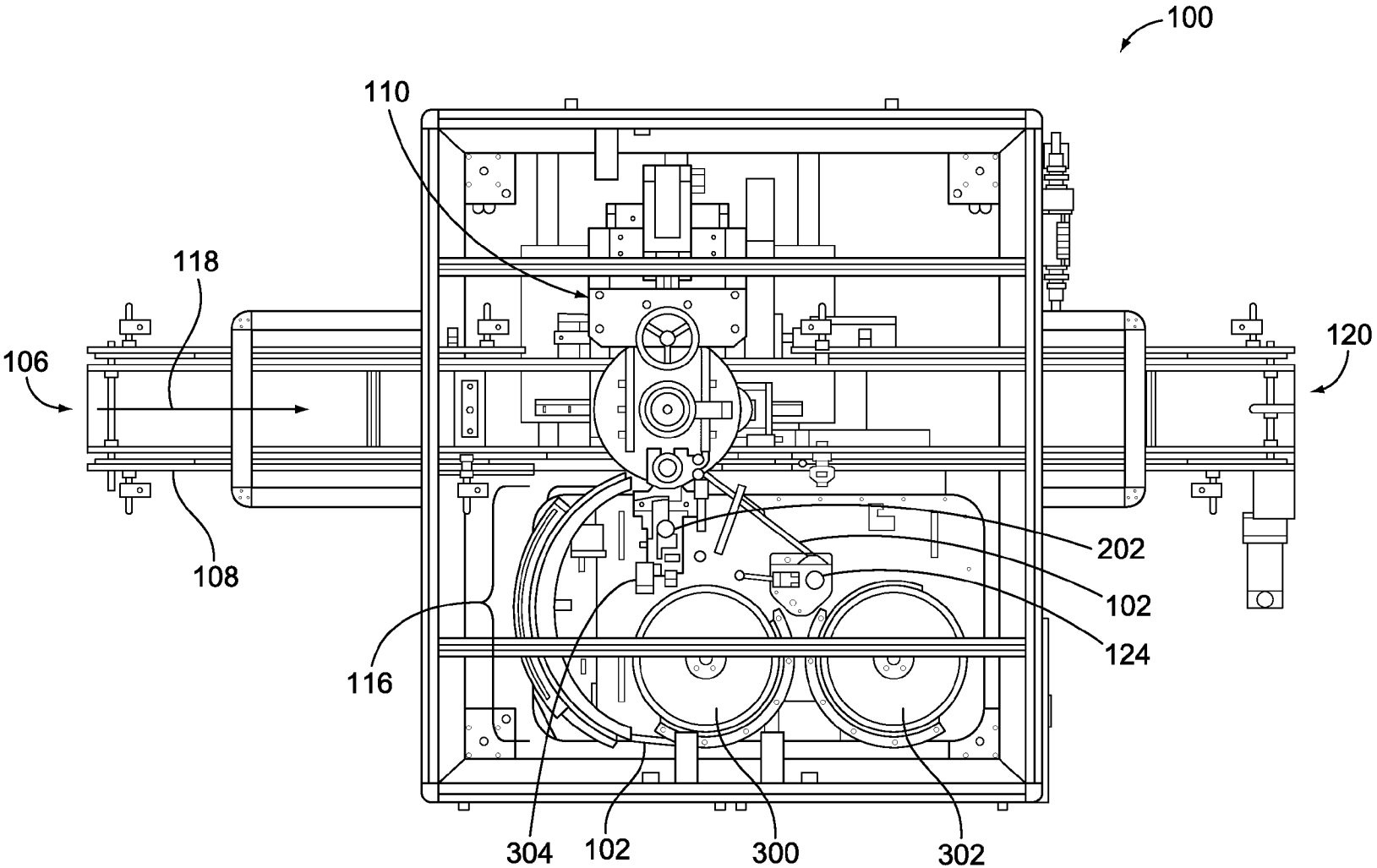
FIG. 3 is a top view of the image application system shown in FIG. 1.

FIG. 1 is a front view of one embodiment of an image application system 100. FIG. 2 is a side view of the image application system 100 shown in FIG. 1. FIG. 3 is a top view of the image application system 100 shown in FIG. 1. The illustrated image application system 100 is a heat transfer system that prints images on exterior surfaces of target objects 200 (shown in FIG. 2) using heat transfer of images from a web 102 to exterior surfaces of the target objects 200. While the target objects 200 shown and described herein are containers (e.g., pails having approximately square cross-sectional shapes), alternatively, the target objects 200 may be another type of object having planar surfaces on which one or more images are applied.

The system 100 includes a control unit 104 (shown in FIG. 1), such as one or more processors, controllers, and the like, that monitor and/or control operations of the system 100. The control unit 104 may operate based on one or more sets of instructions stored on a tangible and non-transitory computer readable medium, such as an internal or external computer memory. The control unit 104 includes an operator interface 122 that allows a human operator to control the system 100.

The target objects 200 can be loaded into the system 100 at an inlet 106 (shown in FIG. 1) and carried through the system 100 by a conveyance and support assembly 108 (shown in FIG. 1 and also referred to herein as "conveyance assembly"). In the illustrated embodiment, the conveyance and support assembly 108 includes one or more conveyors that move the target objects 200 through the system 100. As the target objects 200 move through the system 100, the web 102 may be brought into contact (e.g., physical engagement) with, or in close proximity to, the exterior surfaces of the target objects 200. Images on the web 102 (e.g., text, graphics, and the like) may be transferred to the target objects 200 to print the images onto the target objects 200. For example, the web 102 may represent a continuous roll of a wax transfer print having several images for transferring onto the target objects 200. By "continuous," it is meant that the web 102 may be elongated between opposite ends and have several copies of the same or different images for printing on one or more separate target objects 200 between the opposite ends. Alternatively, the web 102 may represent another carrier of images for being printed onto the target objects. In another embodiment, the web 102 may represent a print head that engages the exterior surfaces of the target objects 200 to print (e.g., using ink jet or other techniques) on the target objects 200. For example, the target objects 200 (and/or applicator devices 202) may be moved to maintain a spatial relationship between the web 102 (or the print head) and the surface of the target object 200 that is receiving the image from the web 102 (or is being printed on by the print head).

In one embodiment, one or more images on the web 102 are printed onto multiple surfaces of the target object 200 that are not co-planar. For example, the images may be printed onto a first planar surface of the target object 200 and a corner (e.g., a rounded corner) of the target object 200 that intersects the first planar surface. As another example, the images may be printed on the first planar surface and a second planar surface that intersect each other at or are deposed on opposite sides of the corner. In another example, the images may be printed on the first planar surface, the corner, and the second planar surface.

In operation, the target object 200 is loaded into the system 100 through the inlet 106. The conveyance and support assembly 108 moves the target object 200 along a direction of travel 118 (shown in FIG. 1) to an articulator assembly 110. As described below, the articulator assembly 110 moves the target object 200 in two or more directions and/or rotates the target object 200 during application of one or more images onto the exterior surfaces of the target object 200. During this application of the images, an applicator device 202 (shown in FIG. 2) applies heat and/or pressure to one side of the web 102 to press the web 102 against a portion of the exterior surface of the target object 200. The applicator device 202 can be coupled with an actuator 304 (shown in FIG. 3) that can move the applicator device 202 toward or away from the target object 200. The actuator 304 can include a device that acts to move the applicator device 202 based on automated instructions or instructions that are manually input into the control unit 104. The actuator 304 can include or represent one or more of a stepper motor, a DC motor, an AC motor, a servomechanism, another type of electric motor, gas cylinder (e.g., air/hydraulic cylinder), and the like. The web 102 may be supplied from an applicator assembly 116. In the illustrated embodiment, the applicator assembly 116 includes a supply reel 300 (shown in FIG. 3) and a take-up reel 302 (shown in FIG. 3). The web 102 can be unrolled from the supply reel 300, pass between the applicator device 202 and the target object 200 to apply the images to the target object 200, and be rolled onto the take-up reel 302. When the supply of web 102 having images is exhausted, the used up web 102 on the take-up reel 302 may be removed and a new web 102 may be wound around the supply reel 300 or a new supply reel 300 with a new web 102 may be provided. In one embodiment, a web motor 124 can rotate a spindle, reel, or other take-up device that is connected to the web 102 in order to cause the web 102 to be unrolled from the supply reel 300 and wound onto the take-up reel 302. Additionally or alternatively, the take-up reel 302 may be connected to the web motor 124 so that the take-up reel 302 is rotated to move the web 102 through the system 100.

During application of the images onto the target object 200, the web 102 moves between the applicator device 200 and the target object 200 while the target object 200 is concurrently moved. The web 102 is moved so that the web 102 is rolled across the exterior surfaces of the target object 200 and the images on the web 102 are rolled onto the exterior surfaces of the target object 200. In one embodiment, the articulator assembly 110 moves the target object 200 relative to the applicator device 202 such that the separation distance between the exterior surfaces of the target object 200 and the applicator device 202 remain constant while the images are applied from the web 102. For example, the applicator device 202 may remain stationary while the articulator assembly 110 moves the target object 200 to keep the web 102 pressed against the exterior surfaces of the target object 200 by the applicator device 202 across two or more planar surfaces that are disposed in different planes. By "stationary," it is meant that the applicator device 202 may not move during application of the images in either lateral direction 112, 114 shown in FIG. 1 or along either transverse direction 204, 206 shown in FIG. 2. The applicator device 202 may, however, rotate about (e.g., around) an axis of rotation of the applicator device 202.

Once application of the one or more images from the web 102 onto the target object 200 is completed. The target object 200 is transferred from the articulator assembly 110 to the conveyance and support assembly 108. The conveyance and support assembly 108 moves the target object 200 along the direction of travel 118 to an outlet 120 of the system 100, where the target object 200 is removed from the system 100.

Figure 4:
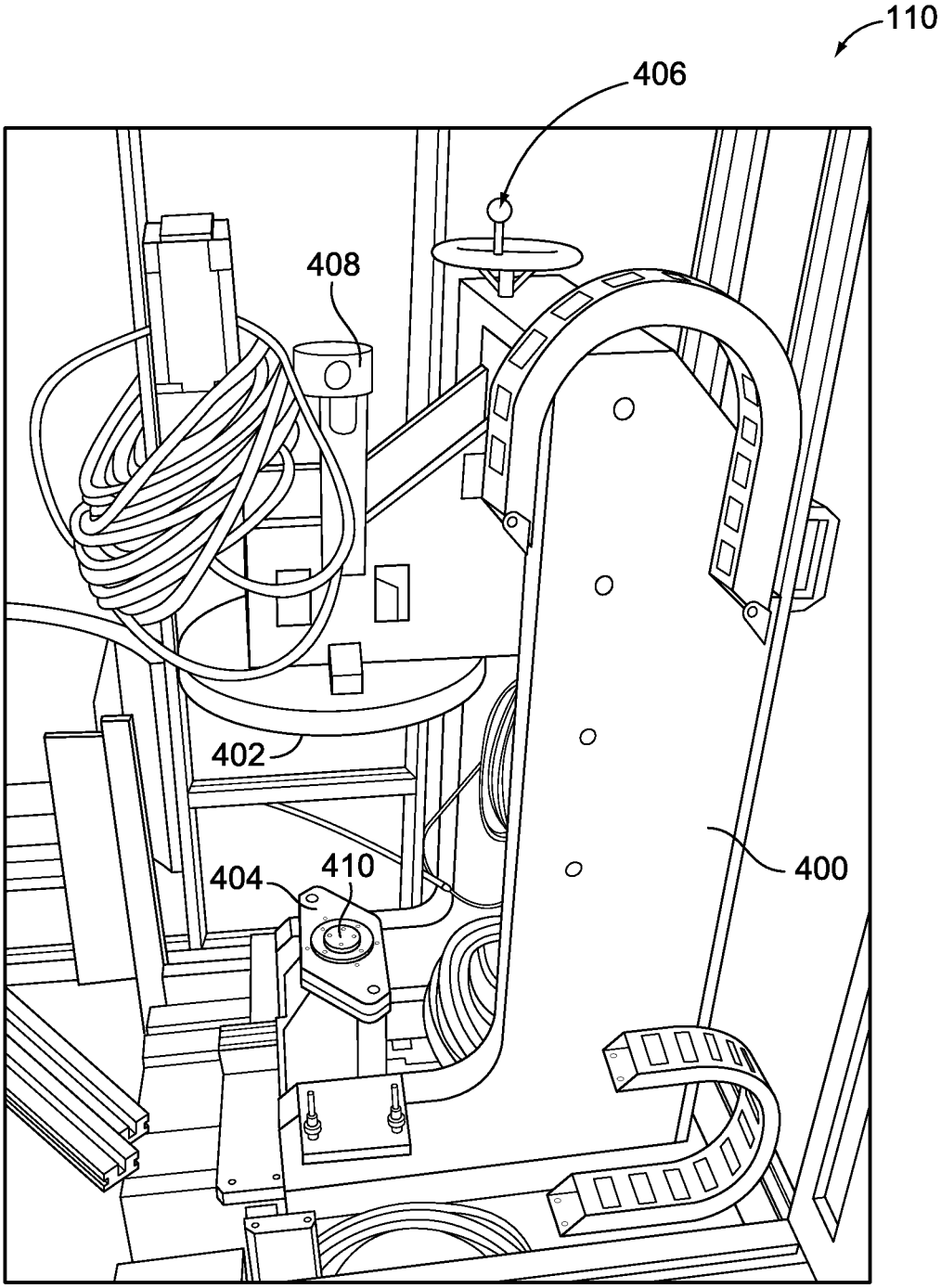
FIG. 4 is a perspective view of one embodiment of an articulator assembly shown in FIG. 1.
Figure 5:
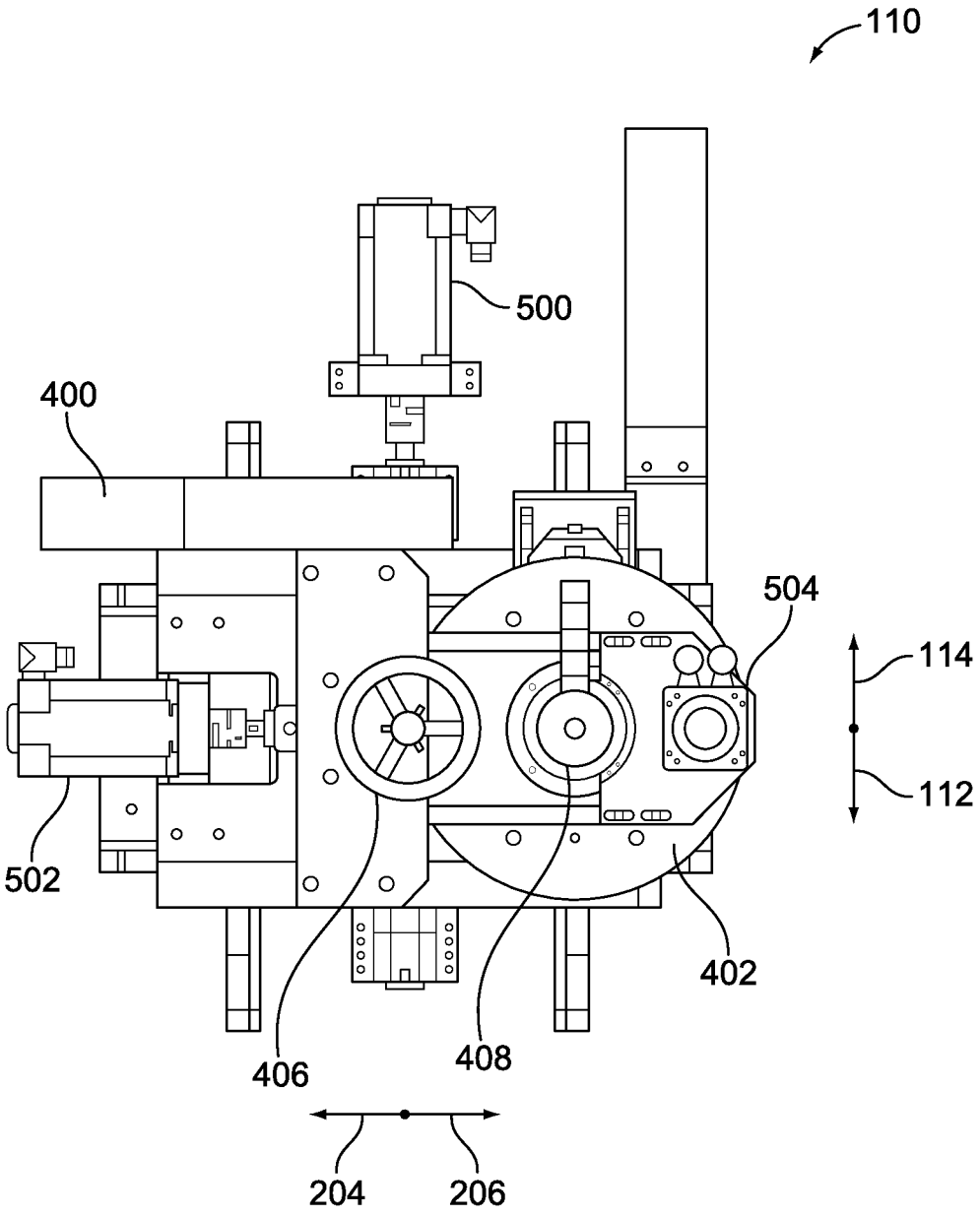
FIG. 5 is a top view of the articulator assembly shown in FIG. 4.
Figure 6:
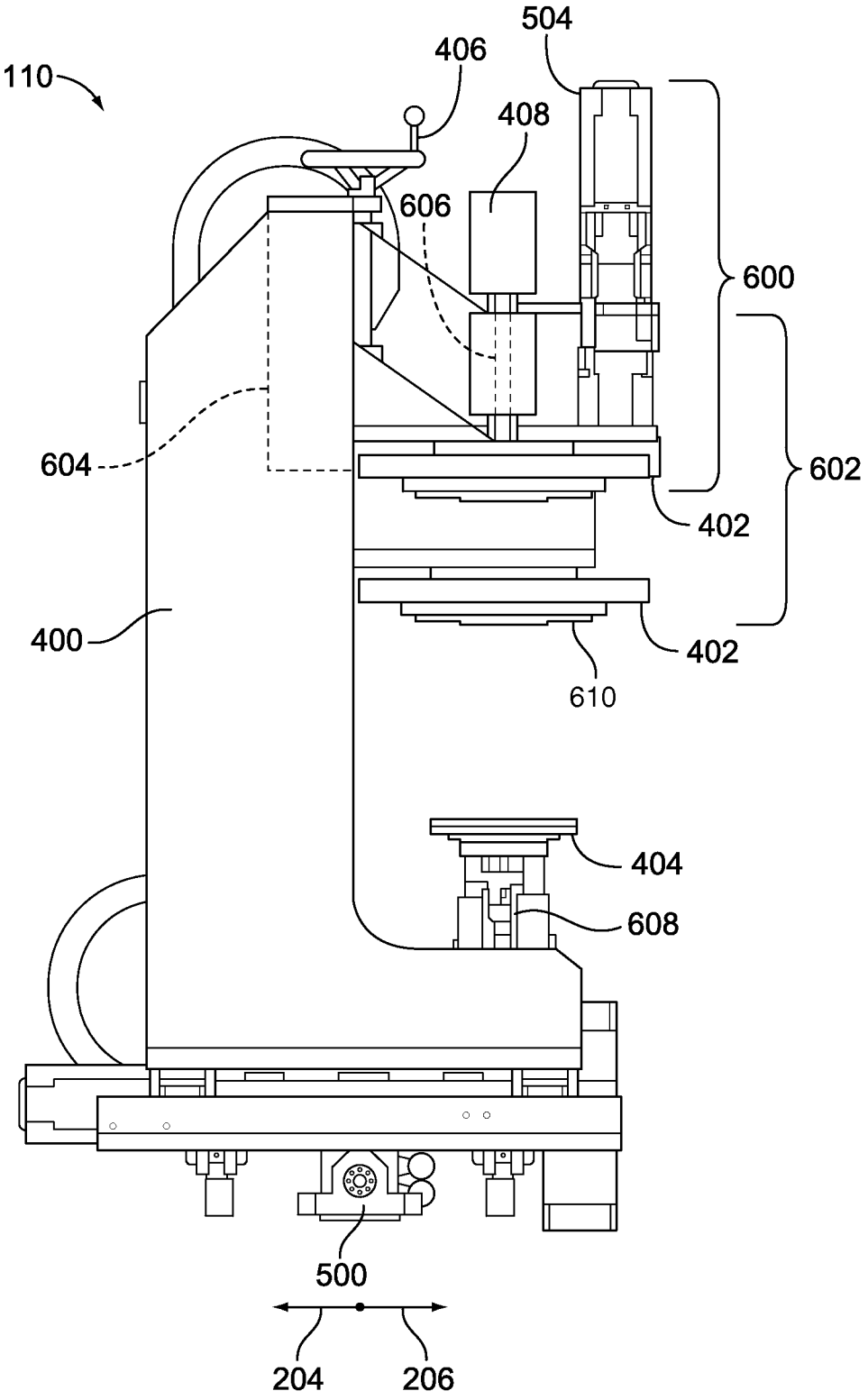
FIG. 6 is a side view of the articulator assembly shown in FIG. 4.

FIG. 4 is a perspective view of one embodiment of the articulator assembly 110 shown in FIG. 1. FIG. 5 is a top view of the articulator assembly 110 shown in FIG. 4. FIG. 6 is a side view of the articulator assembly 110 shown in FIG. 4. The articulator assembly 110 includes a support structure 400 that supports an upper engagement device 402 above a platform 404 (shown in FIG. 4). In operation, the target object 200 (shown in FIG. 2) is received between the platform 404 and the engagement device 402. For example, the conveyance and support assembly 108 (shown in FIG. 1) may move the target object 200 along the lateral direction 114 (shown in FIG. 1) to the platform 404. When the target object 200 is on the platform 404, the engagement device 402 may contact an upper edge or surface of the target object 200 to secure the target object 200 between the engagement device 402 and the platform 404.

Prior to receiving the target object 200 on the platform 404, the platform 404 may be in a lowered position (e.g., a position spaced apart from the engagement device 402. When the target object 200 is received on the platform 404, an actuator 608 can raise the platform 404 until the target object 200 engages the engagement device 402 such that the engagement device 402 contacts the upper edge or surface of the target object 200. The engagement device 402 can then move with the platform 404 and the target object 200 to apply the images to the target object 200, as described below. For example, the engagement device 402 can be coupled with the platform 404 and free from restrictive engagement with the support structure 400 so that movement of the platform 400 also moves the engagement device 402. The actuator 608 can represent a motor, gas (e.g., air/hydraulic) cylinder, or other device capable of raising and lowering the platform 404.

In another embodiment, the engagement device 402 is connected with a vertical motor 604 (shown in FIG. 6) that raises or lowers the engagement device 402 relative to the platform 404. The vertical motor 604 can include a device that acts to move the engagement device 402 based on automated instructions or instructions that are manually input into the control unit 104. The vertical motor 604 can include or represent one or more of a stepper motor, DC brushless motor, AC motor, servomechanism, or the like. Prior to receiving the target object 200 on the platform 404, the vertical motor 604 can raise the engagement device 402 (and connected components) to an open position 600 shown in FIG. 6. When the target object 200 is received on the platform 404, the vertical motor 604 can lower the engagement device 402 (and connected components) to a closed position 602 also shown in FIG. 6. In the open position 600, the engagement device 402 is separated from the target object 200. In the closed position 602, the engagement device 402 may be engaged with the upper edge or surface of the target object 200. While in the closed position 602, the engagement device 402 can move with the platform 404 and the target object 200 to apply the images to the target object 200, as described below. For example, the engagement device 402 can be coupled with the platform 404 and free from restrictive engagement with the support structure 400 so that movement of the platform 400 also moves the engagement device 402.

In the illustrated embodiment, the engagement device 402 is coupled with a height actuator 406 that can be used to adjust a vertical position of the engagement device 402 when the engagement device 402 is in the closed position 602. For example, the height actuator 406 can be used to lower the engagement device 402 toward the platform 404 for shorter target objects 200 or to raise the engagement device 402 away from the platform 404 for taller target objects 200. The height actuator 406 is shown as a wheel coupled with a screw that is rotated to lower or raise the engagement device 402, but alternatively may include a motor (e.g., a stepper motor, DC motor, AC motor, servomechanism, or the like) or other device that may be used to automatically or manually raise or lower the engagement device 402.

The engagement device 402 may have a sealing surface 606 (shown in FIG. 6) that engages the upper edge or surface of the target object 200 to form a seal between the engagement device 402 and the target object 200. For example, the engagement device 402 can include a compliant ring or pad (e.g., a ring or pad formed from silicone or another material) as the sealing surface 606 that engages the target object 200 when the engagement device 402 is lowered to the closed position 602. In one embodiment, the target object 200 includes a hollow interior. For example, the target object 200 may be a pail or container having an open ended top. The engagement device 402 and sealing surface 606 can engage the target object 200 to form a seal and to define a sealed chamber inside the target object 200. Such a sealed chamber may be bounded by a lower surface of the target object 200 (e.g., the bottom of the pail or container), the side walls of the target object 200 (e.g., the sides of the pail or container), and the engagement device 402 and/or sealing surface 606.

In order to provide structural support to the exterior surfaces of the target object 200, the articulator assembly 110 may direct a fluid, such as a gas or liquid, into the sealed chamber of the target object 200. For example, the articulator assembly 110 may at least partially inflate the sealed chamber of the target object 200 to resist external forces applied on the target object 200 by the applicator device 202 (shown in FIG. 2) during application of the images onto the target object 200. The articulator assembly 110 may inflate the target object 200 in a manner similar to the inflation of the sealed chamber (1000) of the target object (106) as described and shown in U.S. patent application Ser. No. 13/485,259, which was filed on 31 May 2012, is entitled "Interior Support Assembly And Method For Providing Interior Support To A Target Object Being Printed Upon," and the entirety of which is incorporated by reference into this application (the "'259 application"). In one embodiment, the sealed chamber within the target object 200 is inflated to a pressure of at least 30 pounds per square inch (or 207 kilopascals). The articulator assembly 110 may or may not lower a plug body into the target object 200 similar to the plug body (504) described in the '259 application to define the sealed chamber within the target object 200. For example, the target object 200 may be closed on all sides except for the portion that engages the engagement device 402.

A rotary union device 408 may provide a fluid coupling between a source of a fluid used to inflate the target object 200 and a conduit 610 that is fluidly coupled with the sealed chamber within the target object 200 when the target object 200 is sealed to the engagement device 402. For example, the rotary union device 408 can couple with a source of pressurized gas in order to deliver the gas into the sealed chamber of the target object 200 via the conduit 610. The inflation of the target object 200 can provide a resistive force that prevents or reduces the applicator device 202 from bending, indenting, or otherwise making the exterior surfaces of the target object 200 concave, similar to the resistive force (1102) shown and described in the '259 Application. Once application of the images onto the target object 200 is complete, the engagement device 402 may be raised by the vertical motor 604 in order to break the seal and release the pressurized fluid (e.g., gas) within the target object 200.

Figure 7:
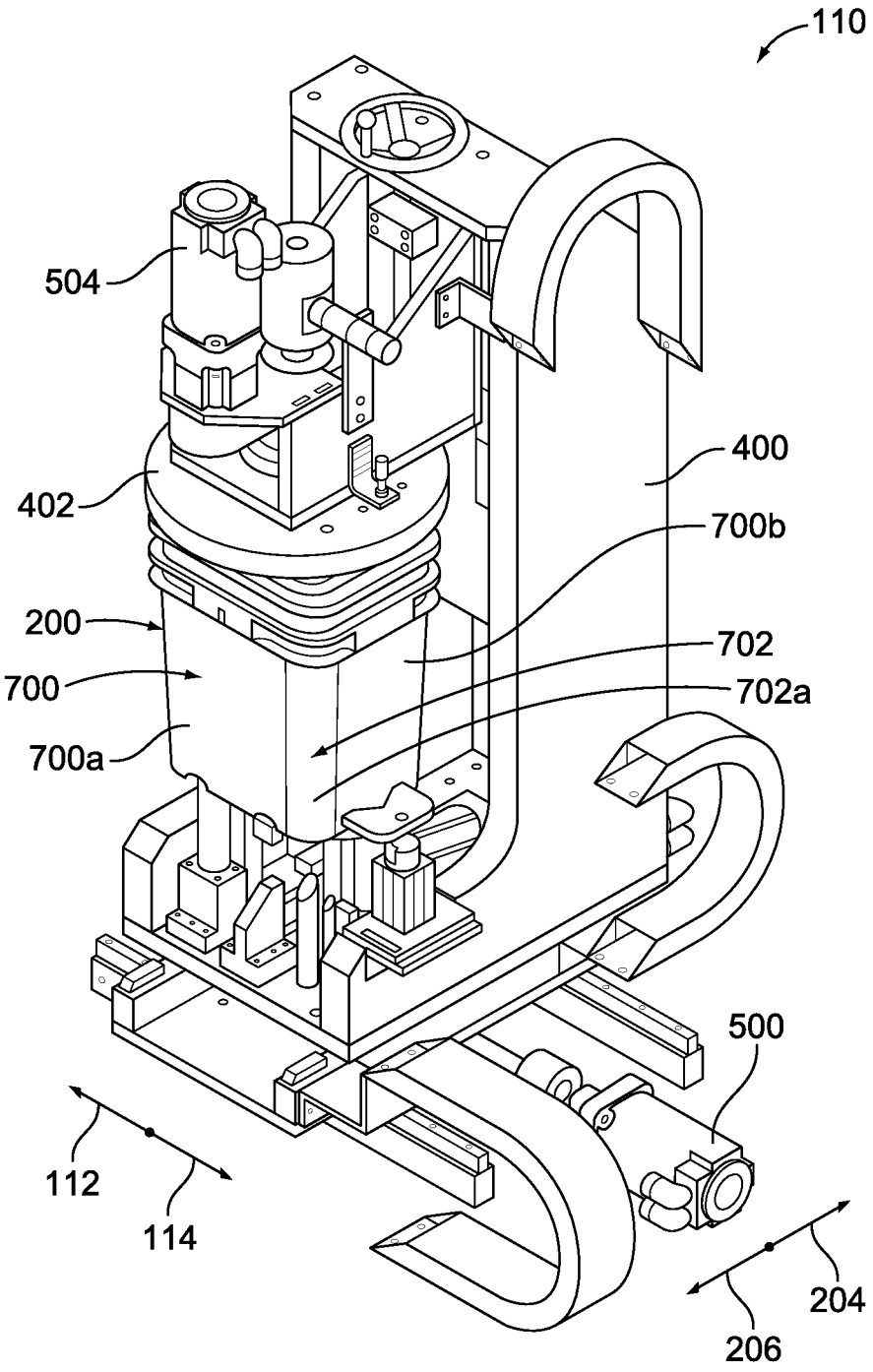
FIG. 7 illustrates a perspective view of a target object shown in FIG. 2 secured in the articulator assembly shown in FIG. 1 in accordance with one embodiment.
Figure 8:
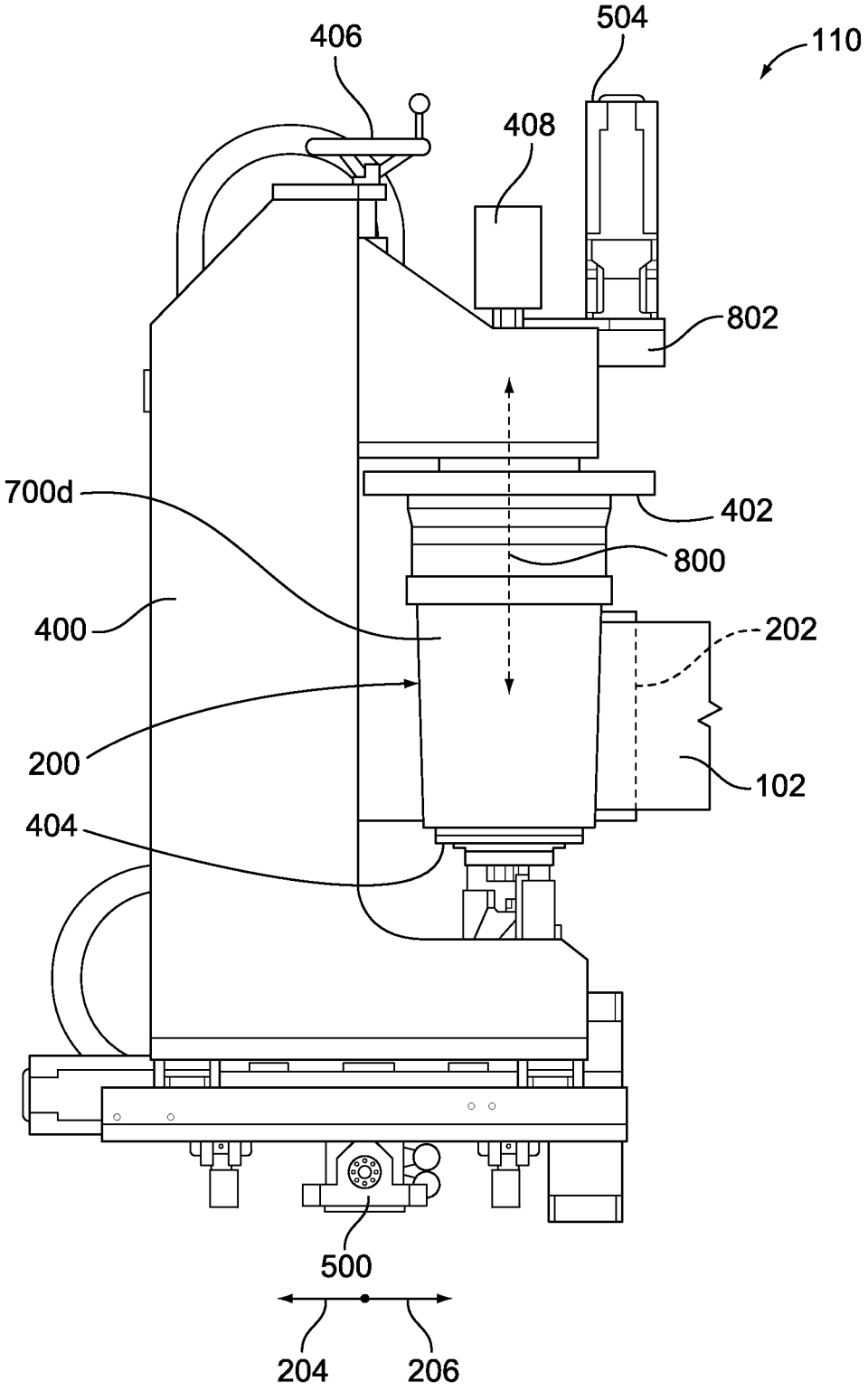
FIG. 8 illustrates a side view of the target object shown in FIG. 2 secured in the articulator assembly shown in FIG. 1 in accordance with the embodiment shown in FIG. 7.
Figure 9:
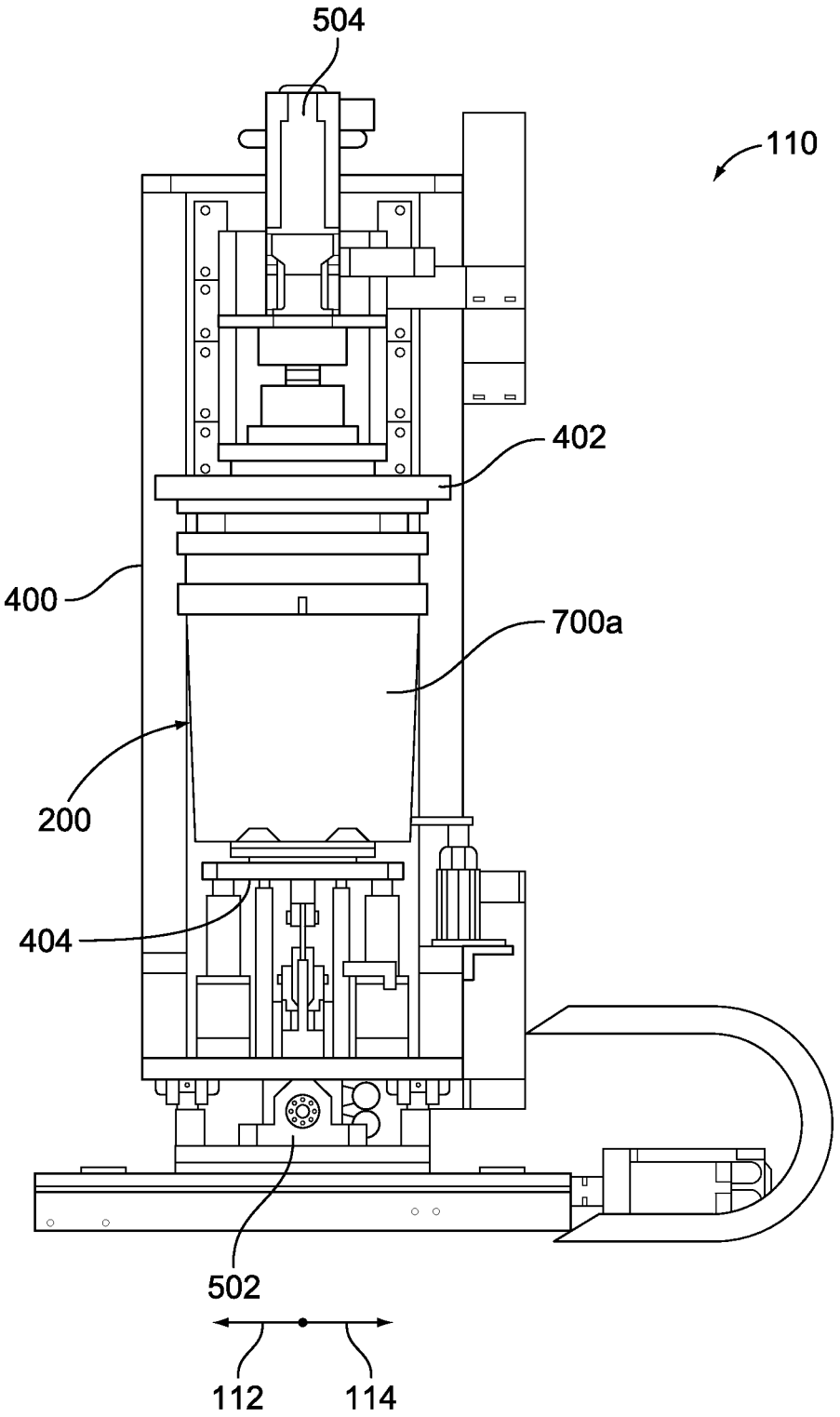
FIG. 9 illustrates a front view of the target object shown in FIG. 1 secured in the articulator assembly shown in FIG. 1 in accordance with the embodiment shown in FIG. 7.

With continued reference to FIGS. 4 through 6, FIG. 7 illustrates a perspective view of the target object 200 secured in the articulator assembly 110 in accordance with one embodiment, FIG. 8 illustrates a side view of the target object 200 secured in the articulator assembly 110 in accordance with the embodiment shown in FIG. 7, and FIG. 9 illustrates a front view of the target object 200 secured in the articulator assembly 110 in accordance with the embodiment shown in FIG. 7. When the target object 200 is received onto the platform 404 from the conveyance and support assembly 108 (shown in FIG. 1), the platform 404 may lift the target object 200 up toward the engagement device 402 and/or the engagement device 402 may lower toward the target object 200 as described above. The target object 200 is secured between the platform 404 and the engagement device 402, as shown in FIGS. 7 through 9. Alternatively, only one of the platform 404 and the engagement device 402 may secure the target object 200.

The applicator device 202 may move toward the exterior surface of the target object 200 to engage the web 102 to the exterior surface of the target object 200, as shown in FIG. 8. For example, the applicator device 202 may be joined to one or more motors (e.g., DC motors, AC motors, stepper motors, servomechanisms, air cylinders and the like) that can move the applicator device 202 toward or away from the target object 200. In the illustrated embodiment, the target object 200 has four planar surfaces 700 (e.g., surfaces 700A shown in FIG. 7, 700B shown in FIG. 7, 700C, and 700D shown in FIG. 8) connected with each other by corners 702 (e.g., corners 702A, 702B, 702C, 702D, although only corner interface 702A is visible in FIG. 7). The surfaces 700 intersect each other at the corners 702. The corners 702 are shown as rounded corners, but alternatively may be non-rounded corners, such as the corners between intersecting sides of a polygon. Although the target object 200 is shown with four surfaces 700 and four corners 702, alternatively, the target object 200 may include a smaller or greater number of surfaces 700 and/or corners 702.

The applicator device 202 may include a cylindrical body that applies heat and/or pressure to the web 102 to force the web 102 against the exterior surfaces of the target object 200 in order to apply images from the web 102 onto the exterior surfaces. The applicator device 202 may be heated from within and/or an external source of heat may be applied at or near the interface between the applicator device 202 and the web 102 and at or near the interface between the web 102 and the target object 200. The applicator device 202 may rotate during application of the images but otherwise remain stationary. During application of the images, the articulator assembly 110 moves the platform 404 and the target object 200 in various directions and/or rotates the platform 404 and the target object 200 to maintain contact between the applicator device 202 and the web 102 and between the web 102 and the target object 200.

In order to move the platform 404 and the target object 200 in such directions, the articulator assembly 110 includes a lateral motor 500 (shown in FIGS. 5 and 7), a transverse motor 502 (shown in FIGS. 5 and 9), and a rotary motor 504 (shown in FIGS. 5 through 9). The motors 500, 502, 504 may represent one or more electric motors (e.g., DC motors, AC motors, stepper motors, servomechanisms, or the like) or other devices that act to move the platform 404 and the target object 200 automatically and/or based on instructions that are manually input into the control unit 104.

The lateral motor 500 is coupled with the platform 404 and moves the platform 404 in the opposite lateral directions 112, 114 relative to the applicator device 202 and/or the support structure 400. For example, the lateral motor 500 may actuate a piston that is coupled with the platform 404 to move the platform 404 (and the target object 200 on the platform 404) in the lateral direction 112 (e.g., by extending the piston) and/or in the lateral direction 114 (e.g., by retracting the piston). Alternatively, the lateral motor 500 may move the platform 404 and target object 200 in the lateral directions 112, 114 using another technique.

The transverse motor 502 is coupled with the platform 404 and moves the platform 404 in the opposite transverse directions 204, 206 relative to the applicator device 202 and/or the support structure 400. For example, the transverse motor 502 may actuate a piston that is coupled with the platform 404 to move the platform 404 (and the target object 200 on the platform 404) in the transverse direction 206 (e.g., by extending the piston) and/or in the transverse direction 204 (e.g., by retracting the piston). Alternatively, the transverse motor 502 may move the platform 404 and target object 200 in the transverse directions 204, 206 using another technique.

The rotary motor 504 is coupled with the engagement device 402 and rotates the engagement device 402 about (e.g., around) an axis of rotation 800 (shown in FIG. 8) relative to the applicator device 202 and/or the support structure 400. For example, the rotary motor 504 may rotate a pinion and/or gear that is connected with the engagement device 402 by one or more connecting mechanisms 802 (shown in FIG. 8), such as belt, pinions and/or gears. The rotation of the engagement device 402 can cause the engagement device 402 and the target object 200 to rotate. The platform 404 may include a rotatable stand 410 (shown in FIG. 4) on which the target object 200 rests when the engagement device 402 engages the target object 200. The stand 410 may be rotatably coupled with the platform 404 such that the stand 410 can rotate around the axis of rotation 800 in one or more rotary directions (e.g., clockwise and/or counter-clockwise around the axis of rotation 800). When the engagement device 402 is rotated by the rotary motor 504, the target object 200 and the stand 410 also are rotated relative to the platform 404. Alternatively, the platform 404 may rotate with the target object 200 relative to the support structure 400 when the rotary motor 504 rotates the engagement device 402. In another embodiment, the stand 410 may not rotate or be provided, and the platform 404 may not rotate such that the target object 200 rotates on and relative to the platform 404 when rotated by the engagement device 402.

The lateral motor 500, transverse motor 502, and/or the rotary motor 504 may coordinate movements of the engagement device 402 and/or the platform 404 in order to maintain interfaces between the applicator device 202, the web 102, and the exterior surface of the target object 200 in the same location while the web 102 rolls past the target object 200, the target object 200 is moved (e.g., laterally, transversely, or by rotation), and/or the applicator device 202 rotates. The control unit 104 may include software, circuitry, and/or other instructions that coordinate these movements. The control unit 104 can create control signals that are communicated to the motors 500, 502, 504 to instruct how and when to move the platform 404 and/or engagement device 402. The control unit 104 may direct the motors 500, 502, 504 to move the target object 200 in two or more of the lateral directions 112, 114, the transverse directions 204, 206, and/or the rotary directions sequentially (e.g., one right after the other), concurrently, or simultaneously.

FIGS. 10 through 16 are schematic diagrams of the target object 200 being moved to apply one or more images on the exterior surface of the target object 200 from the web 102. The views of FIGS. 10 through 16 may be top views of the applicator device 202 and the target object 200 or may be cross-sectional views of the applicator device 202 and the target object 200. The movement of the target object 200 can be created by the movement of the platform 404 (shown in FIG. 4) by the lateral motor 500 (shown in FIG. 5), the transverse motor 502 (shown in FIG. 5), and/or the rotary motor 504 (shown in FIG. 5), as described above. Also as set forth above, the applicator device 202 can apply pressure and/or heat onto a portion of the web 102 that is engaged with the exterior surface of the target object 200.

In one embodiment, the speed at which the target object 200 is moved (e.g., linearly and/or rotationally) to apply images to the target object 200 can be based on the speed at which the web 102 moves through the system 100. For example, the speed of movement of the target object 200 can be synchronized with the speed at which the web 102 is unrolled and moved near the target object. This synchronization can be performed by the control unit 104 (shown in FIG. 1). The control unit 104 can direct the speed at which one or more (or all) of the motors 500, 502, 504 move the target object 200 to match or otherwise be based on the speed at which the web motor 124 (shown in FIG. 1) moves the web 102 through the system 100. Additionally or alternatively, a speed sensor 1000, such as an electronic encoder that contacts the exterior surface of the target object 200, can engage the target object 200 and output data representative of how fast the target object 200 is moving. This data can be communicated (e.g., wirelessly and/or through one or more wired connections) to the control unit 104. The control unit 104 can use this speed data to control the speed at which the web 102 is moved through the system 100 to be synchronized with (e.g., match) the speed at which the target object 200 is being moved.

The location of engagement between the web 102 and the exterior surface of the target object 200 may be referred to as an application interface 900. The applicator device 202 may press the web 102 against the target object 200 to define the size of the application interface 900. In one embodiment, the application interface 900 is a one-dimensional line extending parallel to the length of the elongated applicator device 202. For example, the application interface 900 may represent the tangent between the curve defined by the web 102 and the planar surface 700 or corner interface 702 of the target object 200, as shown in FIGS. 10 through 16. Alternatively, the application interface 900 may have a width dimension such that the application interface 900 is an elongated two-dimensional surface area extending in a first direction that is parallel to the length of the applicator device 202 and extending in an orthogonal second direction that is perpendicular to the direction of elongation of the applicator device 202. Such an application interface 900 may be elongated in the first direction by significantly more than the width of the application interface 900 in the second direction (e.g., by one or more orders of magnitude).

The application interface 900 can define where the images from the web 102 are applied to the exterior surface of the target object 200. For example, the applicator device 202 may rotate (as shown by arrow 902 in FIG. 10), the target object 200 may be moved (as shown in FIGS. 10 through 16), and the web 102 may move between the applicator device 202 and the target object 200 (as shown by arrow 904 in FIG. 10) such that different portions of the web 102 engage and transfer the images to different portions of the target object 200. Alternatively, the applicator device 202 may remain stationary (e.g., not rotate).

Figure 10:
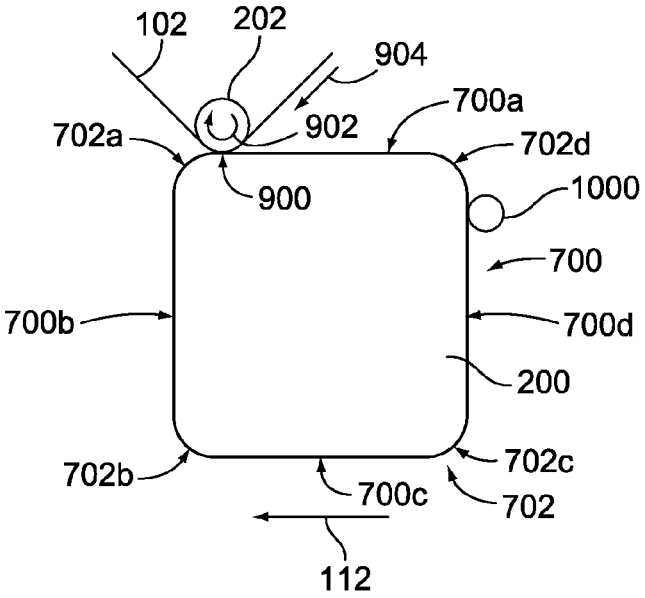
FIG. 10 is a first schematic diagram of the target object shown in FIG. 2 being moved to apply one or more images on the exterior surface of the target object from a web shown in FIG. 1 in accordance with one embodiment.
Figure 11:
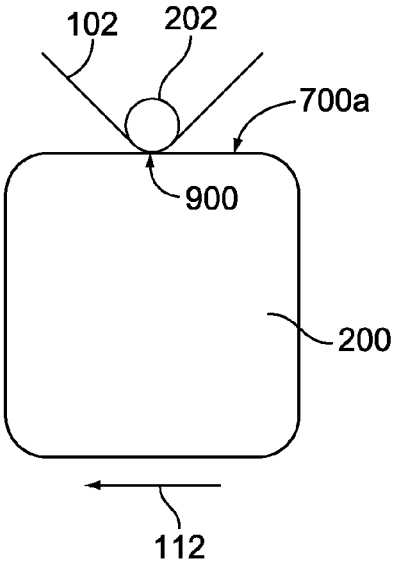
FIG. 11 is a second schematic diagram of the target object shown in FIG. 2 being moved to apply one or more images on the exterior surface of the target object from a web shown in FIG. 1 in accordance with one embodiment.
Figure 12:
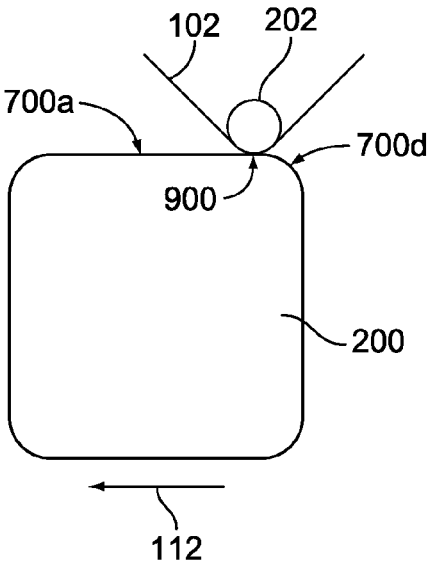
FIG. 12 is a third schematic diagram of the target object shown in FIG. 2 being moved to apply one or more images on the exterior surface of the target object from a web shown in FIG. 1 in accordance with one embodiment.

As shown in FIGS. 10 through 12, in order to apply the images on the web 102 to the planar surface 700A of the target object 200, the applicator device 202 presses the web 102 against the planar surface 700A (and may apply heat) while the target object 200 is moved relative to the applicator device 202. For example, the lateral motor 500 may move the platform 404 in the lateral direction 112 so that the target object 200 is laterally moved relative to the applicator device 202. The application interface 900 between the web 102 and the target object 200 remains stationary while the target object 200 is moved. For example, although different portions of the web 102 engage different portions of the planar surface 700A during movement of the target object 200, the location of interface between the web 102 and the target object 200 may not move during movement of the target object 200.

The images from the web 102 are transferred to the planar surface 700A in areas of the planar surface 700A that trail the applicator device 202 as the target object 200 is moved in the lateral direction 112. For example, the areas of the planar surface 700A that have already engaged the web 102 at the application interface 900 may have the images applied thereto (e.g., the "downstream areas" of the planar surface 700A) while the areas of the planar surface 700A that have not yet engaged the web 102 at the application interface 900 may not have the images applied thereto from the web 102 (e.g., the "upstream areas" of the planar surface 700A). As shown in FIGS. 9 through 11, the target object 200 is moved by the lateral motor 500 such that the images from the web 102 are applied across the planar surface 700A. The web 102 may not entirely cover the planar surface 700A with images, but may include one or more areas that do not receive images from the web 102.

FIGS. 13 through 16 illustrate the target object 200 being moved to apply images to a corner interface 702 of the target object 200 (e.g., the corner interface 702A) and/or to move the applicator device 202 and the web 102 across the corner of the target object 200. The target object 200 is shown with a rounded corner, but alternatively may have a sharp corner, such as the corner formed by an interface between different sides of a polygon. The target object 200 is moved such that the corner interface 702A is moved across the application interface 900. In one embodiment, the web 102 can apply images to the corner interface 702A as the corner interface 702A is moved across the stationary application interface 900. Alternatively, the web 102 may not apply images to the corner interface 702A as the corner interface 702A is moved across the application interface 900.

As shown in FIGS. 13 through 16, in order to move the corner interface 702A across the application interface 900, a combination of movements of the target object 200 are used. For example, the control unit 104 (shown in FIG. 1) may direct the rotary motor 504 to rotate the platform 404 and the target object 200 in a rotary direction 1200 during the same time period that the lateral motor 502 moves the platform 404 and the target object 200 in the lateral direction 112 and/or the transverse motor 500 moves the platform 404 and the target object 200 in the transverse direction 204. Rotation of the platform 404 and target object 200 along the rotary direction 1200 and/or movement of the platform 404 and the target object 200 in the lateral direction 112 can be performed in order to move the corner interface 702A across the application interface 900 and to move the next planar surface 700B toward the application interface 900. Because the applicator device 200 and the application interface 900 may remain stationary, the platform 404 and the target object 200 can be moved in the transverse direction 204. For example, without moving the platform 404 and the target object 200 in the transverse direction 204, the corner interface 702A of the target object 200 may extend too far toward the applicator device 200 such that the application interface 900 moves. The corner interface 702A may effectively protrude out from the application interface 900 toward the applicator device 200. In order to keep the application interface 900 stationary, the target object 200 and the corner interface 702A are retreated away from the applicator device 202 in the transverse direction 204.

Once the target object 200 has been rotated such that the corner interface 702A moves across the application interface 900, the target object 200 can be moved such that the next planar surface (e.g., the planar surface 702B) moves across the application interface 900, such as is described in connection with FIGS. 9 through 11. When the next corner (e.g., the corner interface 702B) encounters the application interface 900, the target object 200 can be moved such that the corner moves across the application interface 900, such as is described in connection with FIGS. 13 through 16.

The target object 200 can be moved by the motors 500, 502, 504 until the web 102 is applied to designated surfaces of the target object 200. For example, if an operator of the system 100 wants to apply images from the web 102 onto all of the planar surfaces 700 of the target object 200, then the movement process described above in connection with FIGS. 10 through 16 may be repeated for each surface 700 and corner interface 702. The movement may be continuous in that the application interface 900 maintains contact with the target object 200 as the target object 200 is moved with the planar surfaces 700 and the corners 702 moving across the application interface 900. The target object 200 may then be moved away from the web 102 and applicator device 202 (e.g., by moving the target object 200 in the transverse direction 204). Alternatively, less than all of the planar surfaces 700 and/or corners 702 may be printed upon. In such an embodiment, the target object 200 may be moved away from the web 102 and the applicator device 202 after the surfaces 700 and/or corners 702 that are to be printed upon have received images from the web 102. The target object 200 may then be conveyed by the conveyance and support assembly 108 (shown in FIG. 1) to the outlet 120 (shown in FIG. 1) where the target object 200 may be removed from the system 100.

Figure 13:
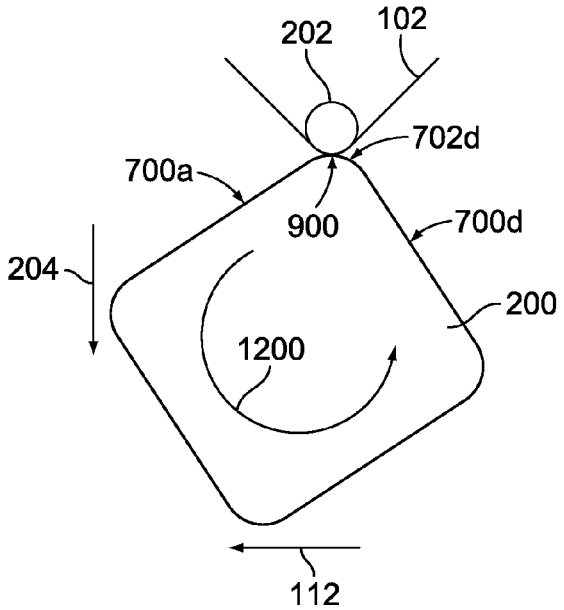
FIG. 13 is a fourth schematic diagram of the target object shown in FIG. 2 being moved to apply one or more images on the exterior surface of the target object from a web shown in FIG. 1 in accordance with one embodiment.
Figure 14:
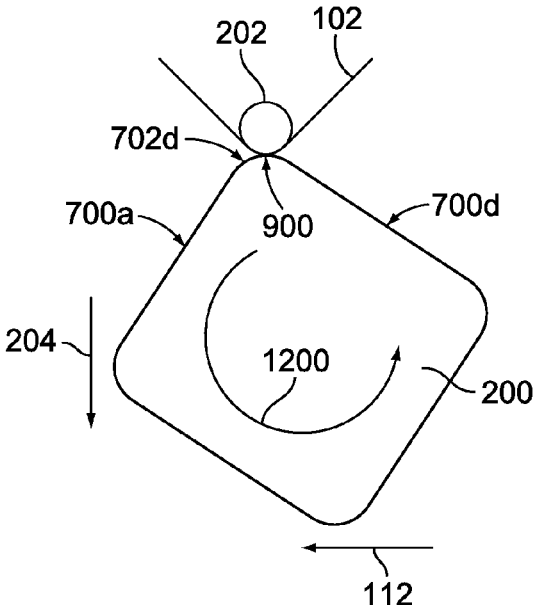
FIG. 14 is a fifth schematic diagram of the target object shown in FIG. 2 being moved to apply one or more images on the exterior surface of the target object from a web shown in FIG. 1 in accordance with one embodiment.
Figure 15:
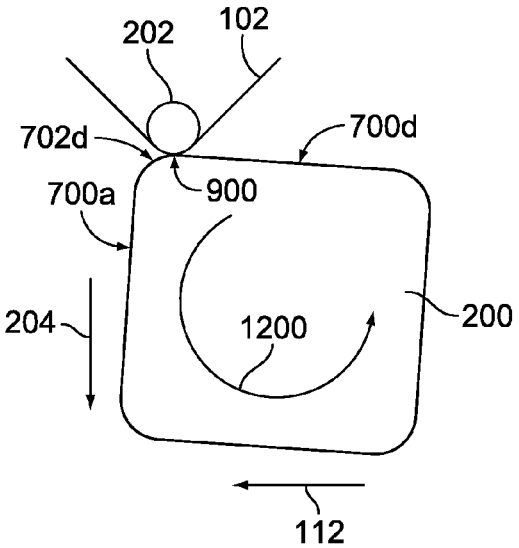
FIG. 15 is a sixth schematic diagram of the target object shown in FIG. 2 being moved to apply one or more images on the exterior surface of the target object from a web shown in FIG. 1 in accordance with one embodiment.
Figure 16:
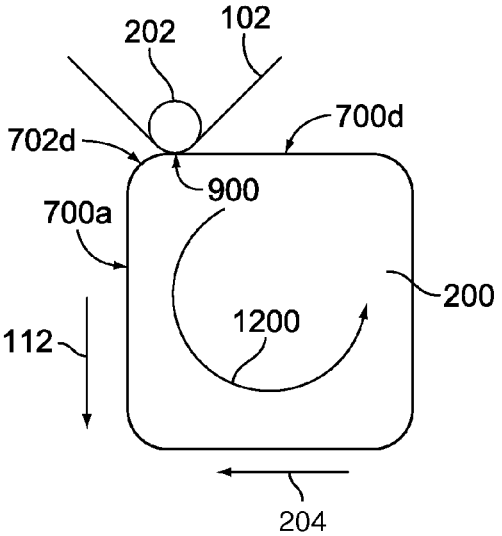
FIG. 16 is a seventh schematic diagram of the target object shown in FIG. 2 being moved to apply one or more images on the exterior surface of the target object from a web shown in FIG. 1 in accordance with one embodiment.
Figure 17:
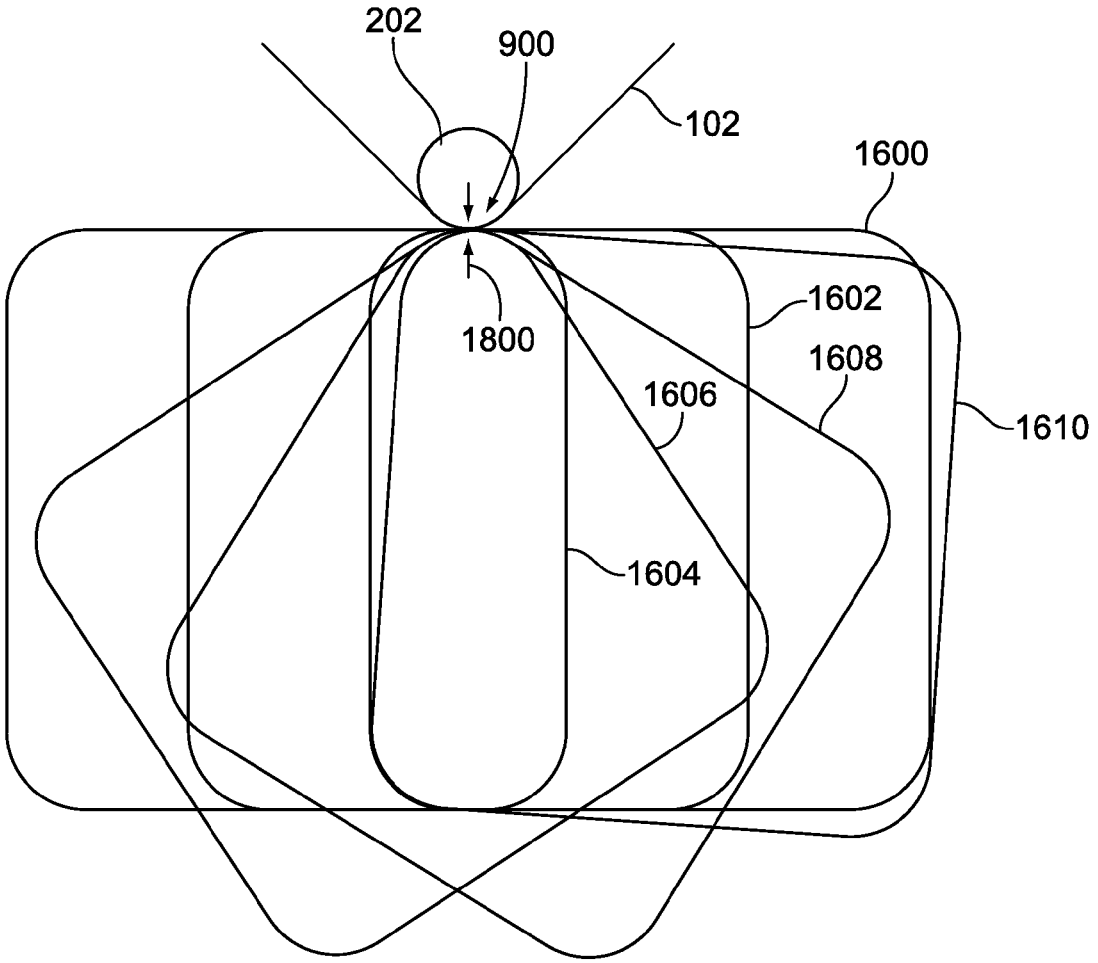
FIG. 17 illustrates example positions of the target object shown in FIG. 2 as the target object is moved relative to an applicator device shown in FIG. 2 in the embodiment shown in FIGS. 10 through 16.

FIG. 17 illustrates example positions of the target object 200 as the target object 200 is moved relative to the applicator device 202 in the embodiment shown in FIGS. 10 through 16. Several positions of the target object 200 are shown and overlaid on each other in FIG. 17 to illustrate how the application interface 900 may remain stationary while the target object 200 is moved. Position 1600 represents the location of the target object 200 in FIG. 10. Position 1602 represents a subsequent location of the target object 200 as shown in FIG. 11. Position 1604 represents a subsequent location of the target object 200 as shown in FIG. 12. Position 1606 represents a subsequent location of the target object 200 as shown in FIG. 13. Position 1608 represents a subsequent location of the target object 200 as shown in FIG. 14. Position 1610 represents a subsequent location of the target object 200 as shown in FIG. 15. The position of the target object 200 in FIG. 16 may also be represented by the position 1600. As shown in FIG. 17, the application interface 900 can remain stationary while the target object 200 is moved in the lateral, transverse, and/or rotary directions. As described above, the target object 200 may be moved such that a separation distance 1800 between the applicator device 202 and the exterior surface of the target object 200 is maintained during movement of the target object 200 and/or application of the images onto the target object 200. The movement cycle of the target object 200 can be repeated to cause additional planar surfaces and corners of the target object 200 to pass through the application interface 900 with the web 102. In one embodiment, the application of images to the target object 200 may be complete when the target object 200 is moved such that the entire or substantially the entire outer perimeter of the target object 200 moves through the application interface 900.

In another embodiment, the applicator device 202 may be moved in addition to or in place of the target object 200. For example, the target object 200 may remain stationary while the web 102 and the applicator device 202 move in the lateral, transverse, and/or rotary directions to move the application interface 900 across the planar surfaces 700 and/or corners 702 of the target object 200. The target object 200 and/or the applicator device 202 may have coordinated movements along one or more of the lateral directions, transverse directions, rotary directions, or other directions in order to cause the application interface 900 to move along the portions of the different planar surfaces 700 and/or corners 702 of the target object 200 that are to receive images from the web 102. Alternatively, the target object 200 and/or the applicator device 202 may have coordinated movements to cause the portions of the different planar surfaces 700 and/or corners 702 of the target object 200 that are to receive images from the web 102 to move across or through the application interface 900.

Figure 18:
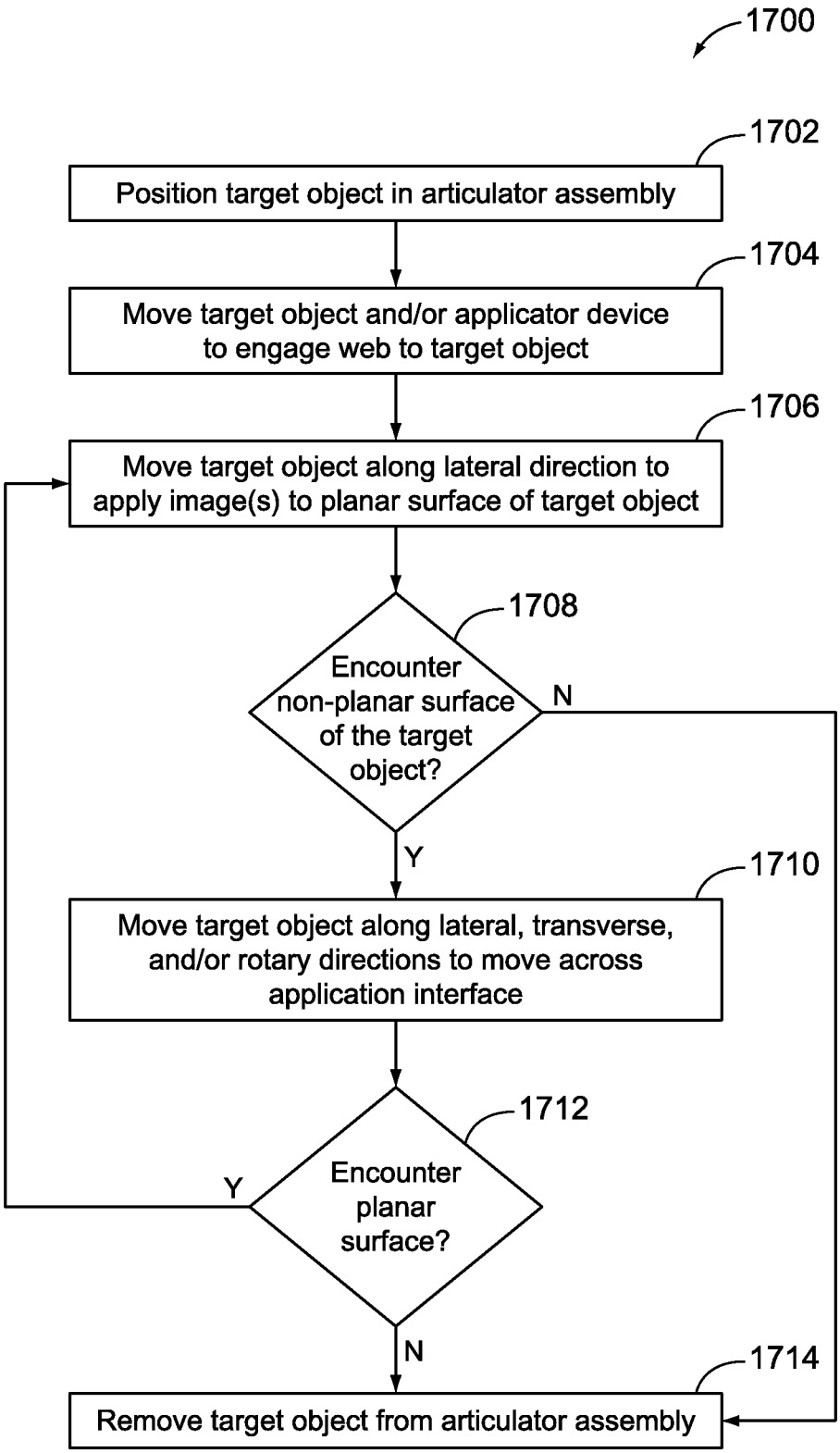
FIG. 18 is a flowchart of a method for applying images to surfaces of a target object.

FIG. 18 is a flowchart of a method 1700 for applying images to different surfaces of a target object. The method 1700 may be used in conjunction with one or more embodiments of the system 100 (shown in FIG. 1) described above. For example, the method 1700 may be used to print images on one or more planar surfaces 700 (shown in FIG. 7) and/or corners 702 (shown in FIG. 7) of the target object 200 (shown in FIG. 2).

At 1702, the target object is positioned in the articulator assembly. For example, the target object 200 may be moved from the inlet 106 (shown in FIG. 1) of the system 100 to the platform 404 (shown in FIG. 4) of the articulator assembly 110 (shown in FIG. 1). The articulator assembly 110 may secure the target object 200, such as by engaging the target object 200 between the engagement device 402 (shown in FIG. 4) and the platform 404.

At 1704, the target object and/or an applicator device are moved to engage a web with the target object. For example, the applicator device 202 (shown in FIG. 2) and/or the target object 200 may move toward the other to sandwich the web 102 (shown in FIG. 1) between the target object 200 and the applicator device 202. When the applicator device 202 presses the web 102 against the target object 200, the applicator device 202 may be separated from the target object 200 by a separation distance that is equal to or in the order of magnitude of the thickness of the web 102. The web 102 may be pressed against or otherwise engage the target object 200 in the application interface 900 shown in FIG. 10.

At 1706, the target object is moved along a lateral direction relative to the applicator device to apply one or more images from the web onto a planar surface of the target object. For example, the target object 200 may be moved in the lateral direction 112 or 114 (shown in FIG. 1) while the applicator device 202 remains stationary (e.g., does not move in the lateral direction 112 or 114). Alternatively, the applicator device 202 also may move in the same or different direction as the target object 200. The target object 200 and/or the applicator device 202 can be moved so that the planar surface of the target object 200 moves along or through the application interface 900 between the web 102 and the target object 200, as described above.

At 1708, a determination is made as to whether a non-planar surface of the target object is encountered by the application interface. For example, a determination may be made as to whether a surface of the target object 200 is encountered that is not co-planar with the planar surface that received the images. Such a surface may represent the corner interface 702 (shown in FIG. 7) or another portion of the target object 200 that is not disposed in the same plane as the surface that previously passed through the application interface 900. If such a surface is encountered by the application interface, then the movement of the target object (and/or of the applicator device) may need to be modified. For example, the movement of the target object may be modified in order to allow the approaching, non-coplanar surface of the target object to pass through the application interface without moving the application interface. If such a surface is encountered, then flow of the method 1700 may proceed to 1710. Otherwise, flow of the method 1700 continues to 1714.

At 1710, the target object is moved along one or more lateral, transverse, and/or rotary directions to move the non-planar surface across the application interface. For example, the platform 404 and the target object 200 may be moved in one or more of the lateral directions 112, 114 (shown in FIG. 1), moved in one or more of the transverse directions 204, 206 (shown in FIG. 2), and/or rotated to move the corner interface 702 along the application interface 900 without moving the application interface 900. Alternatively, the applicator device 202 may be moved with or without the target object 200 in order to cause the non-planar surface to move across the application interface 900. During movement of the non-planar surface of the target object across the application interface, one or more images may be applied to the non-planar surface.

At 1712, a determination is made as to whether movement of the target object causes a planar surface of the target object to encounter the application interface. For example, a determination may be made as to whether the non-planar surface, such as a corner interface 702, has moved through the application interface 900 such that another planar surface (e.g., another surface 700) is approaching the application interface 900. Such an encounter may occur when the corner interface 702 has moved through the application interface 900. If another planar surface is encountered (and/or a surface that has not yet passed through the application interface), the movement of the target object (and/or applicator device) may need to be altered to maintain contact between the planar surface and the web. As a result, flow of the method 1700 may return to 1706. Otherwise, flow of the method 1700 may proceed to 1714. For example, At 1714, the target object is removed from the articulator assembly. For example, application of the images on the target object may be complete. As a result, the target object can be removed from the articulator assembly.

Figure 19:
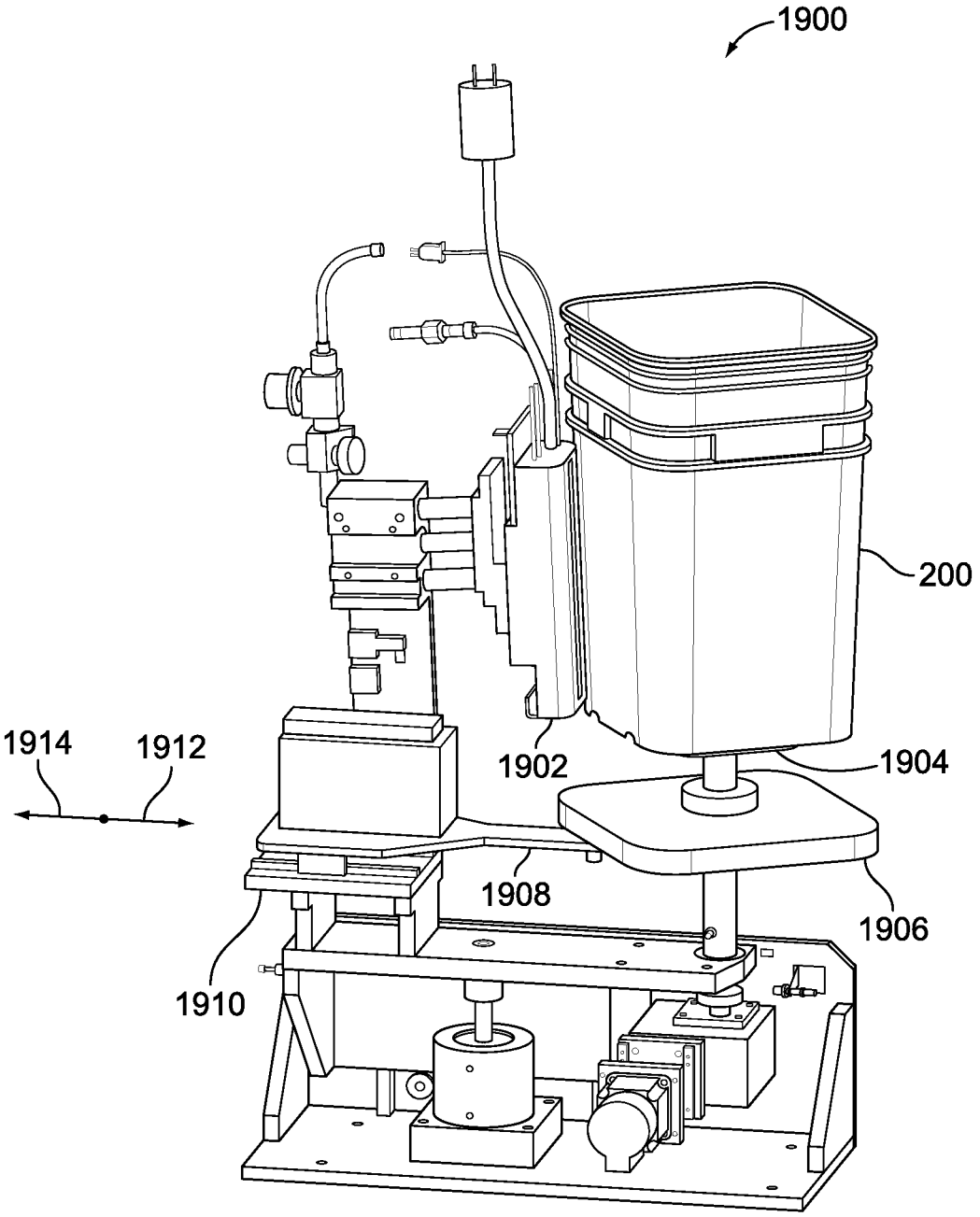
FIG. 19 is a perspective view of another embodiment of an image application system.

FIG. 19 is a perspective view of another embodiment of an image application system 1900. The system 1900 may be used to apply one or more images from the web 102 (shown in FIG. 1) to an exterior surface of the target object 200, similar to the system 100 (shown in FIG. 1). One difference between the systems 100, 1900 is that the system 1900 moves the position of an applicator device 1902 toward and away from the target object 200 instead of moving the target object 200 toward and away from the applicator device 1902 to apply the images onto the target object 200 from the web 102. With the exception of this movement, the applicator device 1902 may be similar to the applicator device 202 (shown in FIG. 2). For example, the applicator device 1902 may apply heat and/or pressure to the web 102 that passes between the applicator device 1902 and the target object 200 in order to transfer one or more images from the web 102 onto the target object 200.

The system 1900 includes a platform 1904 that supports the target object 200. The platform 1904 is connected to a cam plate 1906 that is coupled with an arm 1908, such as a rigid elongated body. The arm 1908 is slidably coupled to a base 1910 of the system 1900. For example, the arm 1908 may be connected to one or more tracks of the base 1910 that are oriented toward the target object 200 such that the arm 1908 can slide toward and away from the base 1910 along the tracks. The arm 1908 is connected with the applicator device 1902 such that movement of the arm 1908 relative to the base 1910 also moves the applicator device 1902 relative to the base 1910. For example and as described below, as the arm 1908 moves in an advancing direction 1912, the applicator device 1902 also moves in the same advancing direction 1912. When the arm 1908 moves in an opposite retreating direction 1914, the applicator device 1902 also moves in the same retreating direction 1914. When the applicator device 1902 engages the web 102, the web 102 also moves in the same direction as the applicator device 1902.

Figure 20:
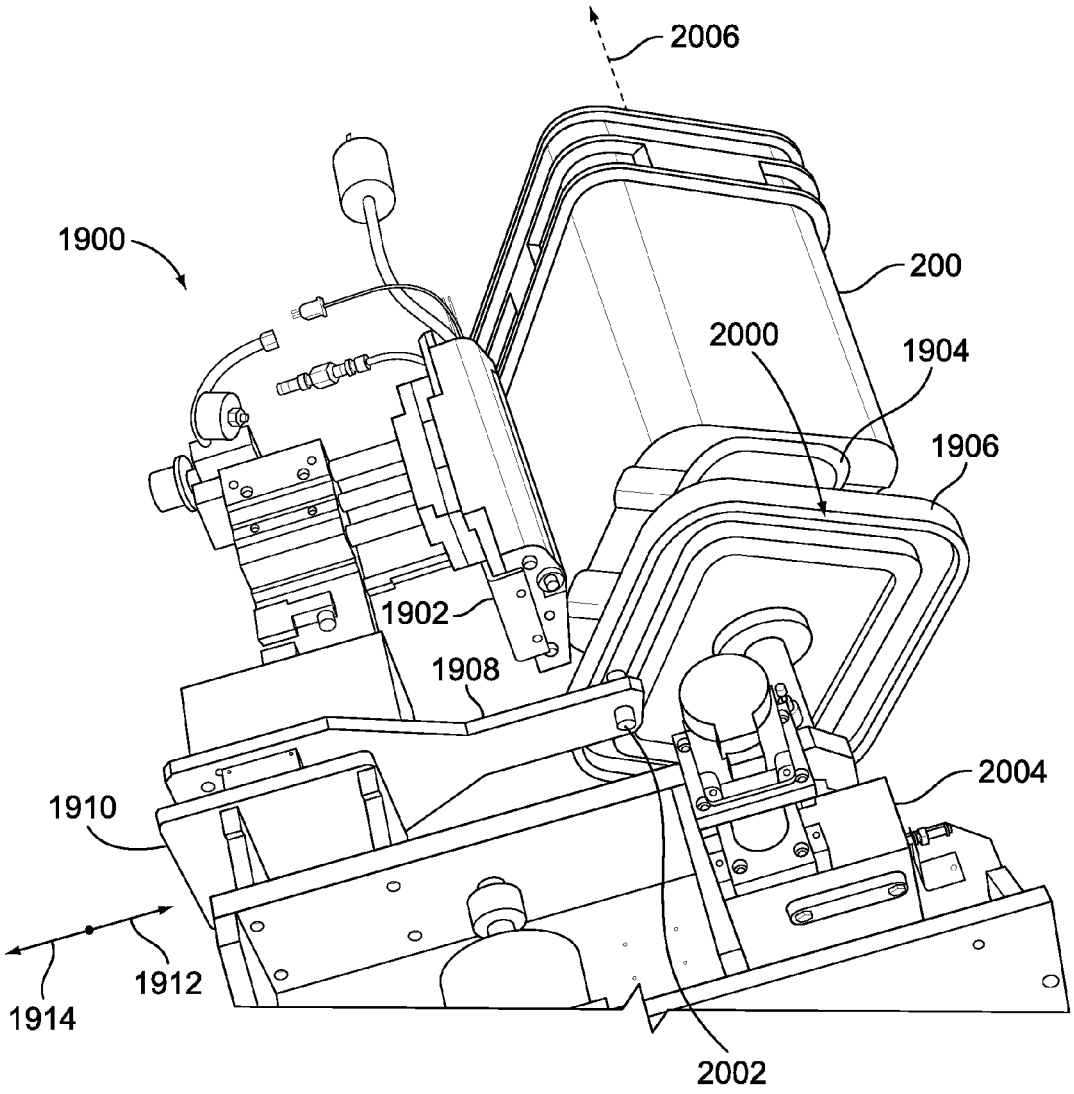
FIG. 20 is a bottom perspective view of one embodiment of the system shown in FIG. 19.

FIG. 20 is a bottom perspective view of one embodiment of the system 1900. As shown in FIG. 20, the cam plate 1906 includes a guide track 2000 that engages the arm 1908. In the illustrated embodiment, the arm 1908 includes a vertically oriented pin 2002 that is received in the guide track 2000. The guide track 2000 can be formed as a recess that extends into the bottom side of the cam plate 1906. Alternatively or additionally, the guide track 2000 can be formed by walls that protrude from the bottom side of the cam plate 1906.

The guide track 2000 defines a path that corresponds to the shape of the target object 200. For example, the guide track 2000 may follow a path that is the same as or is approximately the same as the cross-sectional shape of the target object 200 (e.g., in a horizontal plane). The arm 1908 is secured to the guide track 2000, such as by the pin 2002.

A rotary motor 2004 is connected with the cam plate 1906 such that the rotary motor 2004 rotates the cam plate 1906. The rotary motor 2004 can be communicatively coupled with the control unit 104 so that the control unit 104 can control when and/or how fast the rotary motor 2004 rotates the cam plate 1906. The rotary motor 2004 rotates the cam plate 1906 about (e.g., around) a rotation axis 2006 in the illustrated embodiment. The rotary motor 2004 may rotate the cam plate 1906 without the rotary motor 2004 or another component of the system 1900 also moving the cam plate 1906 laterally, transversely, vertically, or in another direction.

As the rotary motor 2004 rotates the cam plate 1906 about the rotation axis 2006, the target object 200 also rotates about the rotation axis 2006. Additionally, the arm 1908 moves along the guide track 2000. For example, the pin 2002 that is coupled with the arm 1908 may move along the guide track 2000 as the rotary motor 2004 rotates the cam plate 1906. This movement of the pin 2002 in the guide track 2000 causes the arm 1908 to move in the advancing and retreating directions 1912, 1914. For example, as the pin 2002 moves along the guide track 2000 toward a corner or interface between two linear portions of the guide track 2000 that point toward the base 1910, the arm 1908 moves in the retreating direction 1914. As the pin 2002 moves along the guide track 2000 away from the corner or interface, the arm 1908 moves in the advancing direction 1912. Consequently, the pin 2002 traces the shape or approximate shape of the target object 200 and the arm 1908 moves in corresponding advancing and retreating directions 1912, 1914 in concert with the different sides of the target object 200 moving by the applicator device 1902. This movement of the arm 1908 in the advancing and retreating directions 1912, 1914 based on the tracing of the path defined by the guide track 2000 causes the applicator device 1902 to also move in the same advancing and retreating directions 1912, 1914, 23. The arm 1908 can be a rigid body such that the connection of the arm 1908 with the cam plate 1906 and with the base 1910 translates the tracing of the arm 1908 along the path defined by the guide track 2000 into sliding of the arm 1908 along the base 1910 in the advancing and retreating directions 1912, 1914.

The path defined by the guide track 2000 can cause the applicator device 1908 to move toward and away from the target object 200 as the different sides of the target object 200 rotate by the applicator device 1908. As a result, the applicator device 1908 can move relative to the target object 200 in order to keep the applicator device 1908 positioned the same distance or approximately the same distance away from the exterior surface of the target object 200 as the target object 200 is rotated. Consequently, the applicator device 1908 may apply a uniform or approximately constant pressure on the web 102 and the target object 200 as the different sides of the target object 200 move by the applicator device 1908.

When application of the one or more images from the web 102 onto the target object 200 is complete, the target object 200 can be removed from the platform 1904. If another, differently shaped and/or sized target object is to be used, the cam plate 1906 can be removed and replaced with another cam plate that has a guide track that approximates or represents the cross-sectional shape of the new target object, similar to as described above. While the guide track 2000 is shown as being part of the cam plate 1906, alternatively, the platform 1904 may have the guide track 2000 such that the arm 1908 engages the platform 1904 instead of or in addition to the cam plate 1906.

In one embodiment, an image application system includes an articulator assembly and an applicator device. The articulator assembly is configured to hold a target object on which one or more images are to be applied from a web containing the one or more images. The target object includes an exterior surface having one or more planar surfaces and one or more non-planar surfaces. The applicator device is configured to contact the web to engage the web with the exterior surface of the target object at an application interface between the web and the exterior surface. The one or more images are applied to the exterior surface from the web at the application interface. The articulator assembly is configured to move the target object in one or more linear directions and one or more rotary directions relative to the applicator device to apply the images to at least one of the one or more planar surfaces or the one or more non-planar surfaces.

In another aspect, the articulator assembly is configured to move the target object relative to the applicator device such that the one or more planar surfaces and the one or more non-planar surfaces move through the application interface while the application interface remains stationary.

In another aspect, the articulator assembly is configured to move the target object relative to the applicator device to maintain a separation distance between the applicator device and the exterior surface of the target object at the application interface as the one or more planar surfaces and the one or more non-planar surfaces move through the application interface.

In another aspect, the articulator assembly is configured to move the target object in the one or more linear directions and the one or more rotary directions while the applicator device remains fixed in position along the one or more linear directions.

In another aspect, the one or more non-planar surfaces of the target object include a corner interface between neighboring planar surfaces of the one or more planar surfaces. The articulator assembly can be configured to concurrently move the target object in the one or more linear directions and in the one or more rotary directions when the corner interface moves through the application interface between the web and the target object.

In another aspect, the articulator assembly includes a lateral motor configured to move the target object in a lateral direction of the one or more linear directions relative to the applicator device in order to move the one or more planar surfaces through the application interface between the web and the target object.

In another aspect, the articulator assembly includes a lateral motor configured to move the target object in one or more opposite lateral directions of the one or more linear directions, a transverse motor configured to move the target object in one or more opposite transverse directions of the one or more linear directions, and a rotation motor configured to rotate the target object in the one or more rotary directions.

In another aspect, the articulator assembly is configured to move the target object in the one or more lateral directions relative to the applicator device to move the one or more planar surfaces through the application interface between the web and the target object. The articulator assembly is configured to move the target object in at least one of transverse directions and in at least one of the rotary directions to move the one or more non-planar surfaces through the application interface between the web and the target object.

In another aspect, the applicator device is configured to apply at least one of heat or pressure on the web to transfer the one or more images onto the exterior surface of the target object.

In another aspect, the articulator assembly includes an engagement device configured to engage an open end of the target object to form a sealed chamber inside the target object. The articulator assembly is configured to direct a fluid into the sealed chamber to at least partially inflate the target object and support the exterior surface of the target object from within during application of the one or more images to the exterior surface.

In another embodiment, an articulator assembly of an image application system includes a platform and one or more motors. The platform is configured to hold a target object on which one or more images are to be applied from a web containing the one or more images. The target object includes an exterior surface having planar surfaces and at least one non-planar surface extending between the planar surfaces. The one or more motors are configured to move the platform in linear directions and a rotary direction relative to an applicator device that is configured to contact the web to engage the web with the exterior surface of the target object in order to apply the one or more images onto the exterior surface. The applicator device is separated from the exterior surface by a separation distance when the applicator device contacts the web to engage the web with the exterior surface. The one or more motors are configured to move the target object in one or more of the linear directions and the rotary direction by moving the platform. The one or more motors move the target object to maintain the separation distance between the applicator device and the exterior surface of the target object while the target object is moved such that the web engages the planar surfaces and the at least one non-planar surface during movement of the target object.

In another aspect, the one or more motors are configured to move the platform to move the target object such that the web sequentially engages the planar surfaces and the at least one non-planar surface without removing the web from the target object.

In another aspect, the one or more motors are configured to move the platform such that the target object is engaged by the web at an application interface between the web and the exterior surface of the target object. The one or more images are applied to the exterior surface from the web at the application interface.

In another aspect, the one or more motors are configured to move the target object in the one or more linear directions and the rotary direction while the applicator device remains fixed in position along the linear directions.

In another aspect, the at least one non-planar surface of the target object includes a corner interface between the planar surfaces. The one or more motors are configured to concurrently move the platform and the target object in one or more of the linear directions and in the rotary direction when the web engages the corner interface while maintaining the separation distance between the applicator device and the exterior surface of the target object.

In another aspect, the one or more motors include a lateral motor configured to move the target object in a lateral direction of the one or more linear directions, a transverse motor configured to move the target object in a transverse direction of the one or more linear directions, and a rotation motor configured to rotate the target object in the rotary direction.

In another aspect, the lateral motor is configured to move the target object in the lateral direction to move at least one of the planar surfaces across an application interface between the web and the exterior surface of the target object. The rotary motor can be configured to rotate the target object while the transverse motor moves the target object away from the applicator device when the non-planar surface moves across the application interface.

In another embodiment, a method for applying one or more images to a target object including an exterior surface having a planar surface and a non-planar surface is provided. The method includes engaging the exterior surface of the target object with a web at an application interface. The web includes the one or more images to be applied to the target object and held between the exterior surface of the target object and an applicator device. The method also includes moving the target object in a lateral direction to move the planar surface through the application interface and moving the target object in a transverse direction and in a rotary direction to move the non-planar surface through the application interface. The method further includes applying the one or more images to at least one of the planar surface or the non-planar surface during one or more of moving the target object in the lateral direction or moving the target object in the transverse direction and in the rotary direction. A separation distance between the exterior surface of the target object and the applicator device is maintained during moving the target object in the lateral direction and moving the target object in the transverse direction and in the rotary direction.

In another aspect, moving the target object in the lateral direction and moving the target object in the transverse direction and in the rotary direction occur without moving the applicator device in the lateral direction or in the transverse direction.

In another aspect, the method also includes applying one or more of heat or pressure onto the web at the application interface to transfer the one or more images from the web to the exterior surface of the target object.

In another embodiment, an image application system includes an applicator device, a cam plate, and an arm. The applicator device is configured to contact a web that includes one or more images that are to be applied to a target object having an exterior surface of one or more planar surfaces and one or more non-planar surfaces. The applicator device is configured to engage the web with the exterior surface of the target object at an application interface between the web and the exterior surface. The one or more images are configured to be applied to the exterior surface from the web at the application interface. The cam plate is configured to be operably connected with the target object and with a rotary motor. The cam plate is configured to rotate the target object when the rotary motor rotates the cam plate. The cam plate has a guide track that defines a path. The arm is coupled with the applicator device and with the guide track of the cam plate. The arm is configured to move along the guide track in the cam plate when the cam plate is rotated by the rotary motor such that the guide track translates movement of the arm along the guide track into movement of the applicator device relative to the target object in order to apply the one or more images from the web onto the target object.

In another aspect, the path defined by the guide track corresponds to a cross-sectional shape of the exterior surface of the target object.

In another aspect, the arm is a rigid body and is connected with a track on a base that is fixed in position such that the arm is configured to move in opposite advancing and retreating directions toward and away from the target body, respectively.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. An image application system comprising:

an articulator assembly configured to hold a target object on which one or more images are to be applied from a web containing the one or more images, the target object including an exterior surface having one or more planar surfaces and one or more non-planar surfaces;

an applicator device configured to contact the web to engage the web with the exterior surface of the target object at an application interface between the web and the exterior surface, the one or more images applied to the exterior surface from the web at the application interface; and a control unit configured to control a speed at which the articulator assembly moves the target object based on a speed at which the web moves, wherein the control unit synchronizes the speed at which the target object is moved by the articulator assembly with the speed at which the web is moved, wherein the articulator assembly is configured to move the target object in one or more linear directions and one or more rotary directions relative to the applicator device to apply the images to at least one of the one or more planar surfaces or the one or more non-planar surfaces.

2. The system of claim 1, wherein the articulator assembly is configured to move the target object relative to the applicator device such that the one or more planar surfaces and the one or more non-planar surfaces move through the application interface while the application interface remains stationary.

3. The system of claim 1, wherein the articulator assembly is configured to move the target object relative to the applicator device to maintain a separation distance between the applicator device and the exterior surface of the target object at the application interface as the one or more planar surfaces and the one or more non-planar surfaces move through the application interface.

4. The system of claim 1, wherein the articulator assembly is configured to move the target object in the one or more linear directions and the one or more rotary directions while the applicator device remains fixed in position along the one or more linear directions.

5. The system of claim 1, wherein the one or more non-planar surfaces of the target object include a corner interface between neighboring planar surfaces of the one or more planar surfaces, and the articulator assembly is configured to concurrently move the target object in the one or more linear directions and in the one or more rotary directions when the corner interface moves through the application interface between the web and the target object.

6. The system of claim 1, wherein the articulator assembly includes a lateral motor configured to move the target object in a lateral direction of the one or more linear directions relative to the applicator device in order to move the one or more planar surfaces through the application interface between the web and the target object.

7. The system of claim 1, wherein the articulator assembly includes a lateral motor configured to move the target object in one or more opposite lateral directions of the one or more linear directions, a transverse motor configured to move the target object in one or more opposite transverse directions of the one or more linear directions, and a rotation motor configured to rotate the target object in the one or more rotary directions.

8. The system of claim 7, wherein the articulator assembly is configured to move the target object in the one or more lateral directions relative to the applicator device to move the one or more planar surfaces through the application interface between the web and the target object, and the articulator assembly is configured to move the target object in at least one of transverse directions and in at least one of the rotary directions to move the one or more non-planar surfaces through the application interface between the web and the target object.

9. The system of claim 1, wherein the applicator device is configured to apply at least one of heat or pressure on the web to transfer the one or more images onto the exterior surface of the target object.

10. The system of claim 1, wherein the articulator assembly includes an engagement device configured to engage an open end of the target object to form a sealed chamber inside the target object, and the articulator assembly is configured to direct a fluid into the sealed chamber to at least partially inflate the target object and support the exterior surface of the target object from within during application of the one or more images to the exterior surface.

11. The system of claim 1, wherein the articulator assembly comprises:

a platform configured to hold the target object;

one or more motors configured to move the platform in the one or more linear directions and in the one or more rotary directions relative to the applicator device, the applicator device being separated from the exterior surface by a separation distance when the applicator device contacts the web to engage the web with the exterior surface, wherein the one or more motors are configured to move the target object in one or more of the one or more linear directions and the one or more rotary directions by moving the platform, the one or more motors moving the target object to maintain the separation distance between the applicator device and the exterior surface of the target object while the target object is moved such that the web engages the planar surfaces and the at least one non-planar surface during movement of the target object.

12. The system of claim 11, wherein the one or more motors are configured to move the platform to move the target object such that the web sequentially engages the planar surfaces and the at least one non-planar surface without removing the web from the target object.

13. The system of claim 11, wherein the one or more motors are configured to move the platform such that the target object is engaged by the web at the application interface between the web and the exterior surface of the target object, and wherein the one or more images are applied to the exterior surface from the web at the application interface.

14. The system of claim 11, wherein the one or more motors are configured to move the target object in the one or more linear directions and the one or more rotary directions while the applicator device remains fixed in position along the linear directions.

15. The system of claim 11, wherein the at least one non-planar surface of the target object includes a corner interface between the planar surfaces, and the one or more motors are configured to concurrently move the platform and the target object in one or more of the linear directions and in the one or more rotary directions when the web engages the corner interface while maintaining the separation distance between the applicator device and the exterior surface of the target object.

16. The system of claim 11, wherein the one or more motors include a lateral motor configured to move the target object in a lateral direction of the one or more linear directions, a transverse motor configured to move the target object in a transverse direction of the one or more linear directions, and a rotation motor configured to rotate the target object in the one or more rotary directions.

17. The system of claim 16, wherein the lateral motor is configured to move the target object in the lateral direction to move at least one of the planar surfaces across an application interface between the web and the exterior surface of the target object, and the rotary motor is configured to rotate the target object while the transverse motor moves the target object away from the applicator device when the non-planar surface moves across the application interface.

18. The system of claim 1, wherein the articulator assembly is configured to move the target object in a linear direction concurrently with the applicator device contacting the web to engage the web and apply the one or more images to a first flat surface of the target object, the articulator assembly configured to subsequently rotate the target object concurrently with the applicator device contacting the web to engage the web and apply the one or more images to a corner of the target object, and the articulator assembly is configured to subsequently move the target object in the linear direction concurrently with the applicator device contacting the web to engage the web and apply the one or more images to a different, second flat surface of the target object.

19. The system of claim 1, wherein the control unit includes one or more processors.

20. An image application system comprising:

an articulator assembly holding a target object on which an image is to be applied from a web containing the image;

an applicator device contacting the web to engage the web with the target object and apply the image to the target object at an application interface between the web and the target object, wherein the articulator assembly moves the target in a linear direction concurrently with the applicator device contacting the web to engage the web and apply the image to a first flat surface of the target object, the articulator assembly subsequently rotating the target object concurrently with the applicator device contacting the web to engage the web and apply the image onto and across a corner of the target object, and the articulator assembly subsequently moves the target object in the linear direction concurrently with the applicator device contacting the web to engage the web and apply the image to a different, second flat surface of the target object; and one or more processors determining a first speed at which the web is moving through the image application system and synchronizing a second speed at which the articulator assembly moves the target object based on the first speed at which the web moves.

* * * * *